US006089927A

United States Patent [19]

Seko et al.

[11] Patent Number: 6,089,927

[45] Date of Patent: Jul. 18, 2000

[54] CONNECTOR PROVIDED WITH A RETAINER

[75] Inventors: Satomi Seko; Masamitsu Chishima; Eiji Saijo, all of Yokkaichi, Japan

[73] Assignee: Sumitomo Wiring Systems, Ltd., Japan

[21] Appl. No.: 09/160,082

[22] Filed: Sep. 24, 1998

[30] Foreign Application Priority Data

| | | | |
|---|---|---|---|
| Sep. 24, 1997 | [JP] | Japan | 9-258665 |
| Sep. 24, 1997 | [JP] | Japan | 9-258668 |
| Sep. 24, 1997 | [JP] | Japan | 9-258888 |
| Sep. 26, 1997 | [JP] | Japan | 9-262432 |

[51] Int. Cl.[7] ..... H01R 13/436

[52] U.S. Cl. ..... 439/752

[58] Field of Search ..... 439/752, 595

[56] References Cited

U.S. PATENT DOCUMENTS

| | | | |
|---|---|---|---|
| 5,437,565 | 8/1995 | Atsumi et al. | 439/752 |
| 5,593,326 | 1/1997 | Listing | 439/752 |

FOREIGN PATENT DOCUMENTS 5-23455 of 1993 Japan .

8-250215 of 1996 Japan .

*Primary Examiner*—Gary F. Paumen

*Attorney, Agent, or Firm*—Anthony J. Casella; Gerald E. Hespos; Michael J. Porco

[57] ABSTRACT

A connector is provided with a retainer which can prevent a retainer insertion hole from being exposed to the outside and which has a strong force for retaining terminal fittings. The retainer includes a pair of insertion portions 41, 42 having different lengths extend in parallel from a base portion 43 of a retainer 40, and tapered surfaces 32, 33 for guiding the respective insertion portions 41, 42 in a direction oblique to the insertion direction of terminal fittings 20 are provided at the back of a pair of insertion holes 30, 31 formed in a housing 10 in conformity with the insertion portions 41, 42. When the retainer 40 is guided in the oblique direction, lock projections 45 provided on the retainer 40 directly lock the terminal fittings 20. Since the terminal fittings 20 are directly locked by the retainer 40 in this connector, they can be retained with a strong force. Further, since the insertion holes 30, 31 are open in the front surface of the housing 10, they are covered by a mating connector and not exposed to the outside.

10 Claims, 34 Drawing Sheets

CONNECTOR PROVIDED WITH A RETAINER

BACKGROUND OF THE INVENTION

1. Field of the Invention

The present invention relates to an electrical connector.

2. Description of the Prior Art

There are two types of prior art connectors provided with a retainer, namely, a side retainer type (see Japanese Unexamined Utility Model Publication No. 6-5870) and a front retainer type (see Japanese Unexamined Utility Model Publication No. 5-23455 and Japanese Unexamined Patent Publication No. 8-250215).

A prior art side retainer connector is shown in FIG. 40, and has a retainer 3 mounted in a direction normal to the insertion direction of terminal fittings 2 into a connector housing 1. Accordingly, a retainer insertion hole 4 is open in one side surface of the connector housing 1. This type of retainer has an advantage of retaining the terminal fittings 2 with a large force since the retainer 3 directly locks the terminal fittings 2 as shown in FIG. 41. On the other hand, a prior art front retainer type connector is shown in FIG. 42 and has a retainer 5 inserted into a connector housing 6 along the insertion direction of terminal fittings 2, and a retainer insertion hole 7 is accordingly open in an engaging surface with a mating connector. This type has an advantage that the retainer insertion hole 7 is not exposed by being covered by the mating connector.

There have been no prior art connectors provided with a retainer which have advantages of both types of prior art connectors described above. Accordingly, it is an object of the present invention to provide a connector provided with a retainer in which a retainer insertion hole is substantially covered and terminal fittings are substantially retained with a large force.

SUMMARY OF THE INVENTION

According to the invention, there is provided a connector provided with at least one terminal fitting retained or retainable by a retainer. The retainer is inserted substantially from the front surface of the connector housing or substantially along a direction of mating of the connector with a mating connector so as not to come out. The connector comprises at least one retainer insertion hole into which the retainer is insertable. The retainer is shiftable and/or deflectable to a lock position in such a direction to intersect with the insertion direction of the terminal fitting inside the connector housing. A lock portion on the retainer substantially prevents the terminal fitting from coming out when the retainer is positioned substantially in its lock position.

Accordingly, since the terminal fitting is or can be directly locked by the retainer, it can be retained with a strong force. Further, since the retainer is inserted from the front surface of the housing, the opening of the retainer insertion hole is covered by the mating connector and is not exposed to the outside. In other words, the present invention can provide a connector having advantages of both side retainer type connectors and front retainer type connectors of prior art.

According to a preferred embodiment, at least one guide portion is provided on the retainer and/or on the retainer insertion hole while being arranged at least partially at an angle different from 0° or 180° with respect to the insertion direction of the terminal fitting. The guide portion is provided for contact with the retainer in an oblique direction when the retainer is inserted and/or for forcibly shifting and/or deflecting the retainer in the shifting or deflecting direction to the lock position where the lock portion substantially locks the terminal fitting.

Preferably, the retainer insertion hole is dimensioned such that the retainer is shiftable along a shifting direction which intersects with the insertion direction of the terminal fitting inside the connector housing.

According to a further preferred embodiment, there is provided a connector, in which at least one terminal fitting is inserted from the rear surface of a connector housing. The terminal fitting is retained by a retainer inserted from the front surface of the connector housing so as not to come out. A retainer insertion hole is provided into which the retainer is insertable. The retainer insertion hole is dimensioned such that the retainer is shiftable along a direction intersecting with the insertion direction of the terminal fitting inside the connector housing. A lock projection is provided on the retainer for preventing the terminal fitting from coming out when the retainer is shifted. A guide portion is provided between the retainer and the retainer insertion hole for coming into contact with the retainer in an oblique direction when the retainer is inserted and for shifting the retainer to a position where the lock projection locks the terminal fitting. Accordingly, when the retainer is pushed into the retainer insertion hole, the guide portion provided therebetween is obliquely brought into contact with the retainer, thereby shifting the retainer. As a result, the lock projection faces the terminal fitting in such a direction as to prevent it from coming out of the connector housing.

Preferably, the retainer comprises an insertion portion which is insertable into the retainer insertion hole, a base portion which is provided at a base end of the insertion portion so as to substantially face the front surface of the connector housing, and an auxiliary insertion portion which projects from the base portion. The auxiliary insertion portion is preferably substantially shorter than the insertion portion and is insertable into an auxiliary insertion hole. The guide portion(s) is/are provided both on or between the leading end of the insertion portion and/or the retainer insertion hole and on or between the leading end of the auxiliary insertion portion and/or the auxiliary insertion hole. The two guide portions are provided in two spaced-apart positions with respect to the insertion direction on or between the leading ends of the insertion portion and the auxiliary insertion portion having different lengths and the respective insertion holes. Therefore the retainer can stably be shifted.

Further preferably, a movable range of the lock portion or projection interferes with a terminal fitting that has been insufficiently inserted into the connector housing when the retainer is inserted. Accordingly, even if an attempt is made to push the retainer with the insufficiently inserted terminal fittings, the retainer cannot be pushed to its full lock position by the lock portion or projection due to interference by the terminal fitting. Therefore, the insufficient insertion of the terminal fitting can be noticed.

Further preferably, the terminal fitting is inserted substantially from the rear surface of the connector housing.

Still further preferably, the connector further comprises a partial lock means for locking the retainer on the connector housing in a position, where the lock portion does not lock the terminal fitting and a full lock means is provided for locking the retainer on the connector housing in its lock position.

The guide portion preferably is a slanted and/or curved portion provided on the retainer and/or connector housing.

The retainer, and preferably a base portion thereof may prevent a mating connector from being inserted into the connector, when the retainer is not positioned in its lock position.

According to a further embodiment, at least one insertion portion on the retainer is insertable into the connector housing, such that the leading end there is elastically deformable in a direction intersecting with an insertion direction of the terminal fitting into the connector housing. The insertion portion is formed with a lock projection for locking the terminal fitting so as not to come out when the insertion portion is deformed elastically.

According to still a further embodiment, a connector is provided with at least one terminal fitting inserted from the rear surface of a connector housing. The terminal fitting is retained by a retainer inserted from the front surface of the connector housing so as not to come out. An insertion portion is provided on the retainer and is insertable into the connector housing. The leading end of the insertion portion is elastically deformable in a direction intersecting with an insertion direction of the terminal fitting into the connector housing and is formed with a lock projection for locking the terminal fitting so as not to come out when the insertion portion is elastically deformed. A guide portion is provided between the leading end of the insertion portion and the connector housing for elastically deforming the leading end of the insertion portion by being obliquely brought into contact therewith when the insertion portion is inserted into the connector housing. Accordingly, when the insertion portion of the retainer is pushed into the connector housing, the guide portion is brought obliquely into contact with the insertion portion, thereby elastically deforming the leading end of the insertion portion. As a result, the lock projection faces the terminal fitting in such a direction as to prevent it from coming out. Since the terminal fitting is locked directly by the retainer, it can be retained with a strong force.

Preferably, the insertion portion of the retainer is insertable between a pair of terminal fittings inserted into the connector housing. The leading end of the insertion portion may be split into a pair of split pieces which correspond to the pair of terminal fittings and are elastically deformable in opposite directions. The lock projection may be provided at the leading end of each split piece, and the guide portion may be provided between each split piece and the connector housing. Accordingly, since the split pieces are elastically deformable in opposite directions, the elastic counterforces of the respective split pieces are cancelled. Thus, the retainer can be inserted stably into the housing.

Most preferably, a deformable range of the leading end of the insertion portion when the retainer interferes with a terminal fitting that has been inserted insufficiently into the connector housing.

Accordingly, even if an attempt is made to push the retainer with the insufficiently inserted terminal fitting, the retainer cannot be pushed to its terminal fitting lock position by the lock projection interfering the terminal fitting. Therefore, the insufficient insertion of the terminal fitting can be noticed.

According to still a further preferred embodiment, there are provided at least one retainer insertion hole which is formed in the connector housing and open in a direction toward a mating connector. A retainer is slidable inside the retainer insertion hole in a direction intersecting with the insertion direction of the terminal fitting into the connector housing. A lock projection is provided on the retainer for locking the terminal fitting into the connector housing when the retainer is in a terminal fitting lock position at one end of the retainer insertion hole with respect to its sliding direction. At least one jig insertion space is provided between an inner wall of the retainer insertion hole opposite from the terminal fitting lock position and the retainer. A jig for sliding the retainer to the terminal fitting lock position is insertable into the jig insertion space.

Preferably, there is provided a connector provided with a retainer. The connector comprises a connector housing. A retainer insertion hole is formed in the connector housing and is open in a direction toward a mating connector. A retainer is slidable inside the retainer insertion hole in a direction intersecting with insertion direction of a terminal fitting into the connector housing. A lock projection is provided on the retainer for locking the terminal fitting inserted into the connector housing when the retainer is in a terminal fitting lock position at one end of the retainer insertion hole with respect to its sliding direction. Finally, a jig insertion space which is provided between an inner wall of the retainer insertion hole opposite from the terminal fitting lock position and the retainer and into which a jig for sliding the retainer to the terminal fitting lock position is insertable. Accordingly, when the jig is inserted into the jig insertion space to exert a force in such a direction as to widen this space, the retainer is slid to the terminal fitting lock position in the retainer insertion hole. As a result, the lock projection of the retainer faces the terminal fitting in such a direction as to prevent the terminal fitting from coming out of the connector housing. Since the terminal fitting is directly locked by the retainer, it can be retained with a strong force. Further, the opening made in the connector housing by the retainer insertion hole is covered by the mating connector, and is not exposed to the outside. In other words, the present invention can provide a connector having advantages of both side retainer type and front retainer type connectors of prior art.

Preferably, a tapered surface is formed on at least either of the inner wall of the retainer insertion hole opposite from the terminal fitting lock position and the retainer so that the jig insertion space becomes narrower toward the back thereof. Accordingly, since the jig insertion space is made narrower toward its back by the tapered surface, a force for pushing the jig to the back of the jig insertion space acts in such a direction as to widen this space, so that the retainer can be slid.

Still further preferably, there is provided an inner housing which is insertable into the connector housing from a surface of the connector housing facing the mating connector and locked therein so as not to come out, and the retainer insertion hole preferably extends from the inner housing over to the connector housing. Accordingly, since the retainer insertion hole extends from the inner housing over to the connector housing, the inner housing and the connector housing are detached from each other and the retainer insertion hole can be wider opened. Thus, the retainer can easily be assembled into the connector housing.

The retainer preferably comprises a connection restricting portion which slides along the front surface of the connector housing and projects into a connection space of the connector housing with the mating connector when the retainer is in a position other than the terminal fitting lock position. Accordingly, when the retainer is in a position other than the terminal fitting lock position, the connection restricting portion interferes with the mating connector, thereby obstructing the connection of the connectors. This prevents the connectors from being assembled without the retainer being located in the terminal fitting lock position.

According to another aspect of the invention, there is provided a connector with at least one terminal fitting inserted into a corresponding cavity formed in a connector housing, preferably from the rear surface of the connector housing. The terminal fitting is retained by a retainer inserted into a retainer insertion hole which is open in the front surface of the connector housing. The connector comprises a resin locking portion for projecting into the cavity to lock the terminal fitting. A deformation area of the resin locking portion is provided substantially at the back of the retainer insertion hole, and an intermediate portion of the retainer insertion hole communicates with one side surface of the cavity. A restricting portion is provided on the retainer for restricting the elastic deformation of the resin locking portion by being inserted into the deformation area in the retainer insertion hole. A metal locking portion receiving projection on the retainer projects into a communicating portion of the retainer insertion hole and the cavity and lockingly engages a metal locking portion formed on the terminal fitting by cutting a portion of the terminal fitting and bending a cut portion in such a direction as to prevent the terminal fitting from coming out.

Accordingly, when the terminal fitting is inserted into the connector housing, the resin locking portion is restored to its original shape after being deformed toward the deformation area, thereby engaging the terminal fitting in such a direction as to prevent it from coming out. If the retainer is inserted to the back of the retainer insertion hole in this state, the restricting portion provided on the retainer is accommodated in the deformation area of the resin locking portion to restrict the elastic deformation of the resin locking portion. As a result, the locking force of the resin locking portion is improved and the metal locking portion of the terminal fitting engages the metal locking portion receiving portion on the retainer in such a direction as to prevent the terminal fitting from coming out. As described above, in this connector, the terminal fitting can be retained with a strong force since the locking force of the resin locking portion is improved by the retainer. Additionally, the terminal fitting is locked by the two locking portions, namely, the resin locking portion and the metal locking portion. Further, since the opening of the retainer insertion hole is located in the front surface of the connector housing, it is covered by the mating connector and not exposed to the outside. In other words, the present invention can provide a connector having advantages of both side retainer type and front retainer type connectors of prior art.

According to a preferred embodiment, the lock projection is formed with an insertion groove in which the metal locking portion is insertable along the insertion direction of the terminal fitting. Accordingly, since the metal locking portion and the lock projection do not interfere with each other along the insertion direction of the terminal fitting due to the presence of the insertion groove, a resistance which acts during the insertion of the terminal fitting into the connector housing is not large and the terminal fitting can be detached easily from the connector housing.

Most preferably, the resin locking portion is deformed toward the deformation area to prevent the insertion of the restricting portion of the retainer into the deformation area when the terminal fitting is insufficiently inserted into the cavity. Accordingly, since the resin locking portion is interfered by the restricting portion when the terminal fitting is insufficiently inserted, the retainer cannot be pushed to the back of the retainer insertion hole. Thus, the insufficient insertion of the terminal fitting can be noticed.

These and other objects, features and advantages of the present invention will become more apparent upon a reading of the following detailed description and accompanying drawings.

DETAILED DESCRIPTION OF THE PREFERRED EMBODIMENTS

Figure 1:
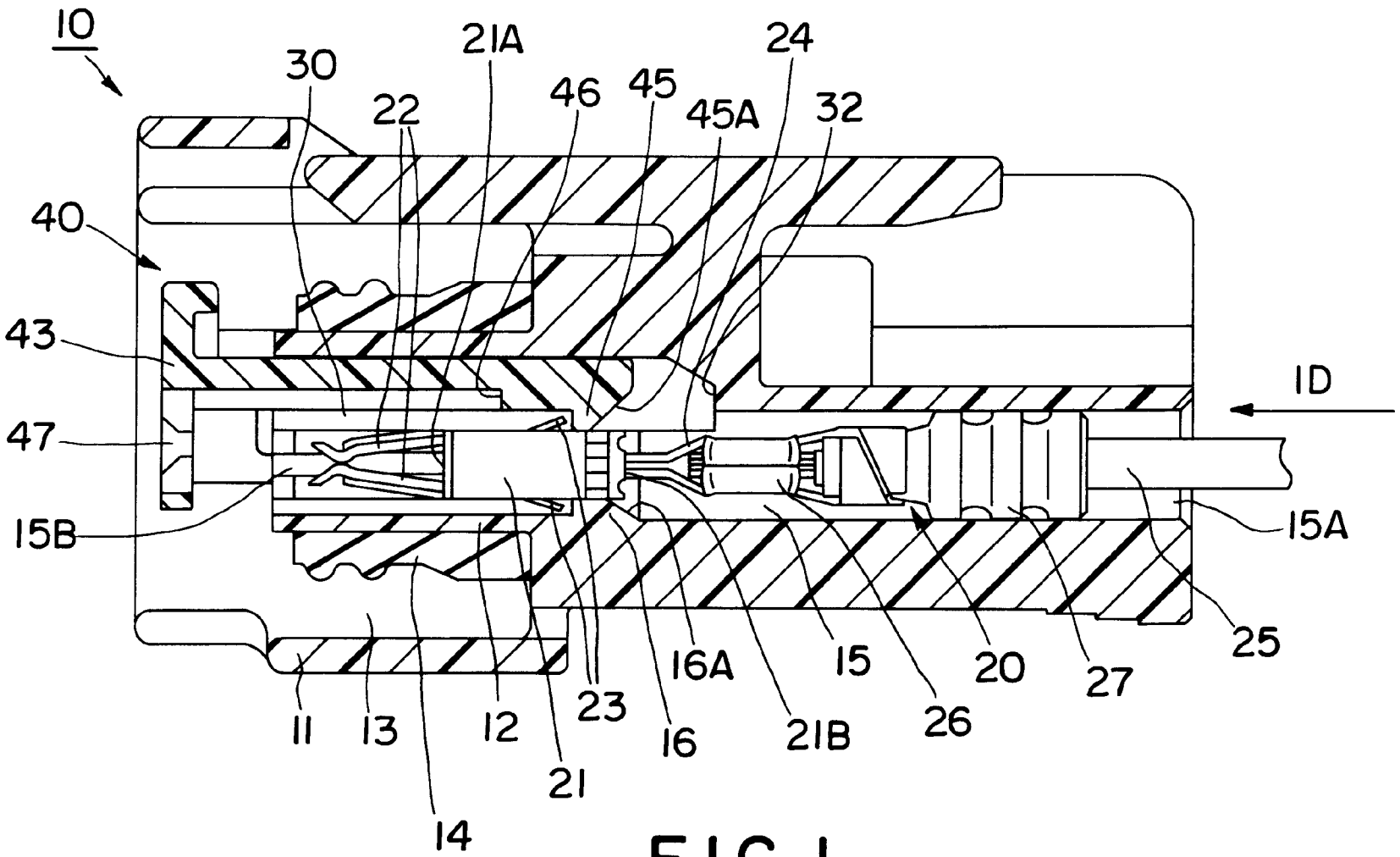
FIG. 1 is a side view in section of a connector provided with a retainer according to one embodiment of the invention.

A connector housing in accordance with a first embodiment of the invention is identified generally by the numeral 10 in FIGS. 1–3 and 6–10. A left end surface of the housing 10 in FIG. 1 is a front surface to be engaged with a mating housing or connector (not shown). A receptacle of the mating housing or connector is insertable into a space 13 between a receptacle wall 11, which projects forward from the front surface of the housing 10, and a main body 12 which is inside the receptacle wall 11 for the connection of the two connectors. Further, a waterproof ring 14 is fit on the outer surface of the main body 12, and is brought into sealing contact with the inner surface of the mating receptacle and the outer surface of the main body 12 by being compressively deformed therebetween.

A pair of cavities 15 are provided inside the housing 10 substantially in the form of through holes extending substantially in or along an engaging direction with a mating connector. Terminal fittings 20 are inserted or insertable in an insertion direction ID through terminal insertion openings 15A of the cavities 15, and are substantially open at the rear side (right side in FIG. 1) of the housing 10. The terminal fittings 20 are connected or connectable electrically with male tabs (not shown) of a mating connector inserted through tab insertion openings 15B of the cavities 15. The tab insertion openings 15B are substantially open at the front side of the housing 10.

The terminal fittings 20 preferably are formed, as shown in FIG. 1, by successively cutting a conductive metal plate and bending the cut pieces. A front end surface 21A of a terminal base portion 21 is substantially in the form of a rectangular parallelepiped. The front end surface 21A is brought or bringable into contact with a contact wall or portion (not shown) formed in the cavity 15, thereby positioning the terminal fitting 20 in the cavity 15 preferably with respect to the forward direction. A pair of substantially opposite pieces 22 which extend substantially forward (or toward the front end surface of the connector housing 10 where the mating connector is inserted or insertable) in directions toward each other or converging from the front end surface 21A of the terminal base portion 21. The male tab of the mating connector is held or holdable between these opposite pieces 22 to establish an electrical connection. Further, a pair of metal lances or locking portions 23 extend obliquely (or at an angle different from 0° or 180° with respect to the insertion direction ID) preferably backwardly from opposite side walls of the terminal base portion 21. These metal locking portions 23 are engaged or engageable lockingly with a receiving projection or portion 16 formed in the cavity 15 and a locking projection 45 or stepped surface 46 (see FIG. 9) of a retainer 40 to be described later so as to substantially prevent the terminal fitting 20 from coming out of the cavity 15.

A barrel portion 26 is formed on a rear end surface 21B of the terminal base portion 21. The barrel portion 26 has a raised portion 24 extending substantially backwardly and preferably from a center portion of the rear end surface 21B. The barrel portion 26 is adapted to connect with a wire 25 at its leading end. An end of the wire 25 and a waterproof rubber plug 27 are connected or connectable with the barrel portion 26 as shown in FIG. 1, and this waterproof rubber plug 27 is or can be brought in sealing contact with an external sheath of the wire 25 and the inner surface of the cavity 15.

Figure 2:
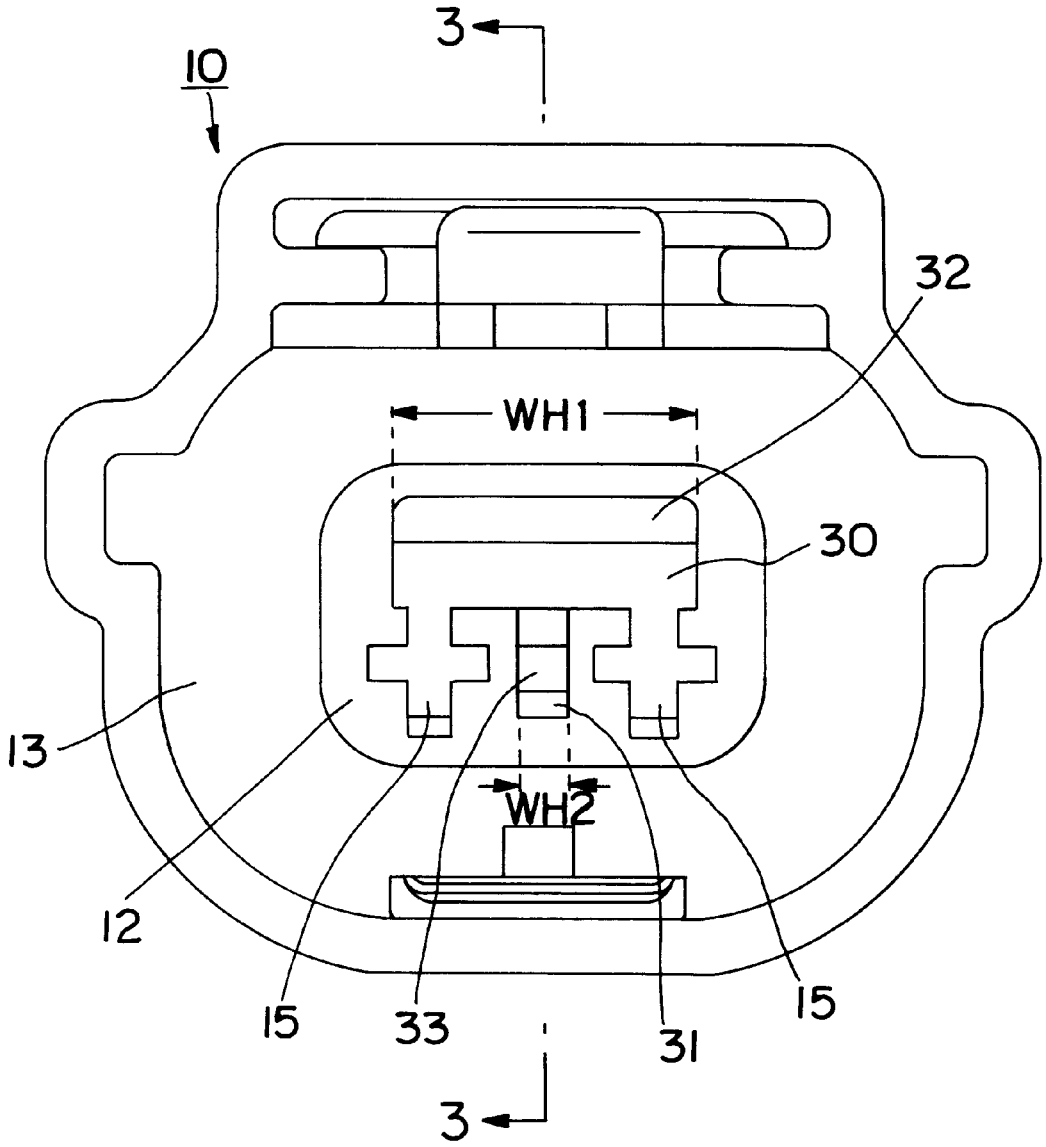
FIG. 2 is a front view of a housing of the connector.
Figure 3:
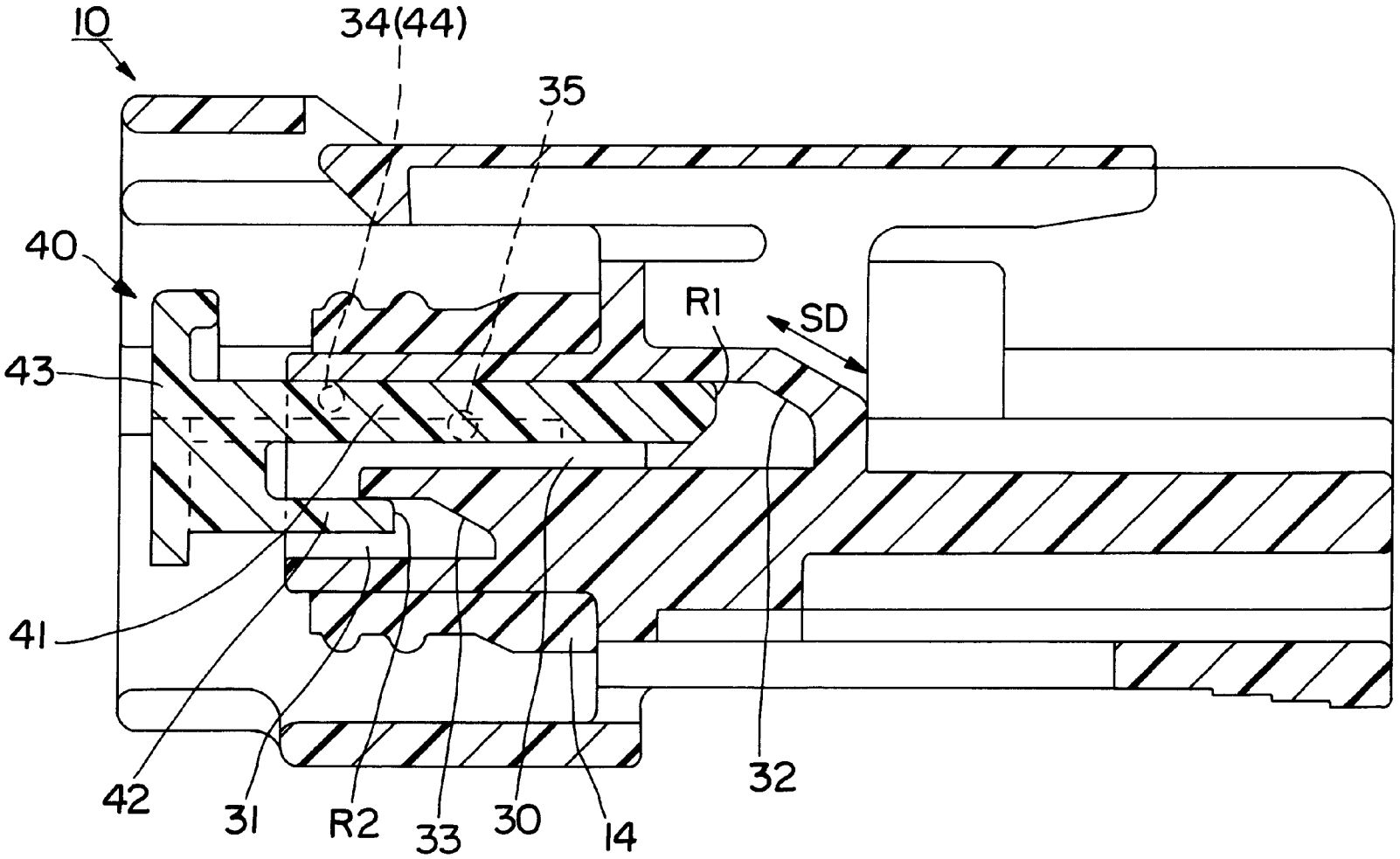
FIG. 3 is a section along 3—3 of FIG. 2.

The housing 10 is formed with a retainer insertion hole 30 and auxiliary insertion hole 31 that are substantially open in the front surface of the main body 12, as shown in FIG. 2. The retainer insertion hole 30 is located substantially above the cavities 15 as shown in FIG. 2 and has a substantially rectangular cross section which is long along the transverse direction of FIG. 2. The auxiliary retainer insertion hole 31 extends to an intermediate position of the housing 10 substantially in parallel with the cavities 15 (see FIG. 3). Further, the retainer insertion hole 30 communicates with upper parts of the cavities 15 (see FIGS. 1 and 2). This communicating portion preferably is widened at the back so as to avoid the interference with the locking projections 45 on the retainer 40. A tapered surface 32 is provided at the rear of the retainer insertion hole 30 and is inclined downwardly toward the rear (right side as shown in FIG. 3). On the other hand, the auxiliary insertion hole 31 is located between the cavities 15 as shown in FIG. 2. The auxiliary insertion hole 31 extends a shorter distance than the retainer insertion hole 30 and is substantially parallel with the retainer insertion hole 31 as shown in FIG. 3. The auxiliary insertion hole 30 communicates with the retainer insertion hole 30 at its open side. The back of the auxiliary insertion hole 31 is provided an auxiliary tapered surface 33 which is inclined substantially in parallel with the tapered surface 32 as shown in FIG. 3.

Figure 4:
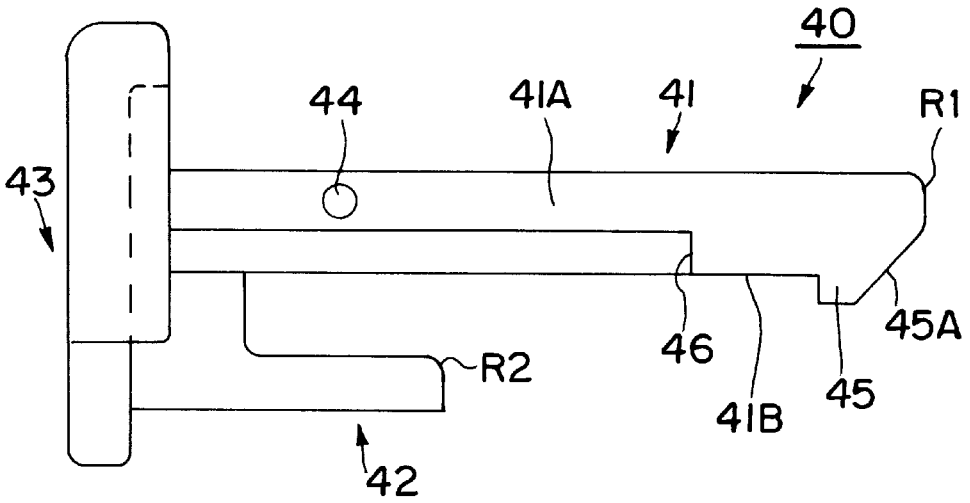
FIG. 4 is a side view of the retainer.

The retainer 40 is, as shown in FIG. 4, such that a main insertion portion 41 and an auxiliary insertion portion 42 extend substantially in parallel from a base portion 43 which is in the form of a flat plate. The main insertion portion 41 is inserted or insertable substantially into the retainer insertion hole 30, whereas the auxiliary insertion portion 42 is inserted into the auxiliary insertion hole 31. The widths W1, W2 (vertical dimensions in FIG. 5) of the insertion portions 41, 42, respectively are substantially equal or correspond to those WH1, WH2 (transverse dimensions in FIG. 2) of the insertion holes 30, 31 respectively, and the thicknesses (vertical dimensions in FIG. 3) thereof are substantially equal or correspond to the vertical dimensions (vertical dimensions in FIG. 3) of the insertion holes 30, 31, respectively. Accordingly, the respective insertion portions 41, 42 can be moved along the vertical direction of FIG. 3 inside the insertion holes 30, 31. Since the insertion portions 41, 42 have lengths substantially corresponding to the respective insertion holes 30, 31, the leading ends thereof are obliquely brought or bringable into contact with the respective tapered surfaces 32, 33 preferably substantially at the same time when the respective insertion portions 41, 42 are inserted into the insertion holes 30, 31. The retainer 40 then is guided obliquely downward to the right of FIG. 3. Further, the upper corner portions or contact portions of the leading ends of the respective insertion portions 41, 42 are rounded (see R1, R2 in FIG. 3) so as to be smoothly brought or bringable into contact with the tapered surfaces 32, 33, thereby preferably providing a facilitated sliding of the respective insertion portions 41, 42 on the tapered surfaces 32, 33, respectively.

Figure 5:
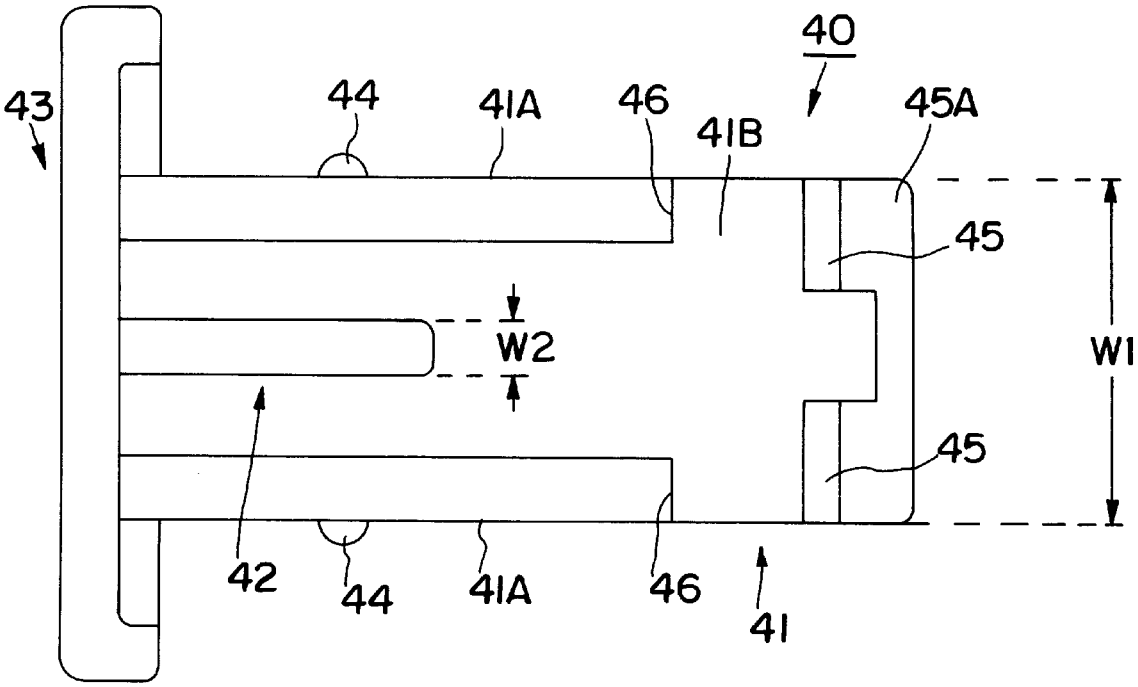
FIG. 5 is a bottom view of the retainer.
Figure 6:
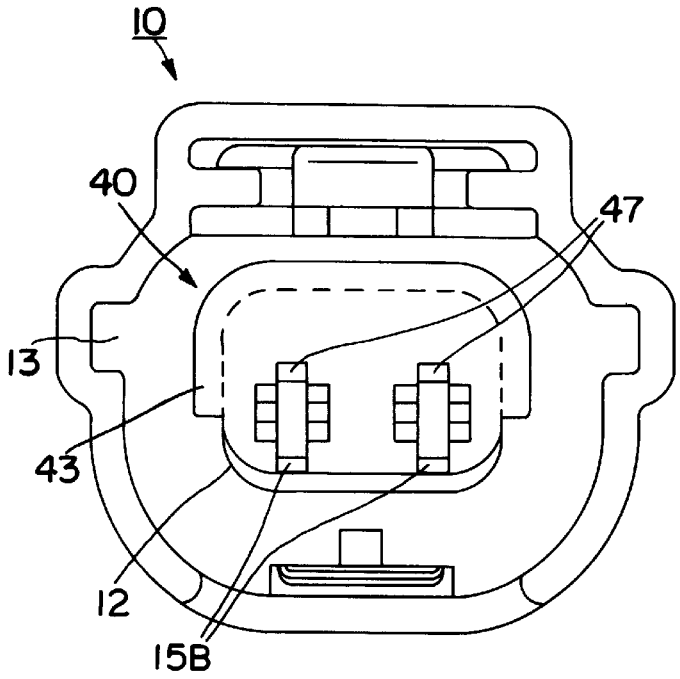
FIG. 6 is a front view of the connector when the retainer is in its partial lock position.
Figure 7:
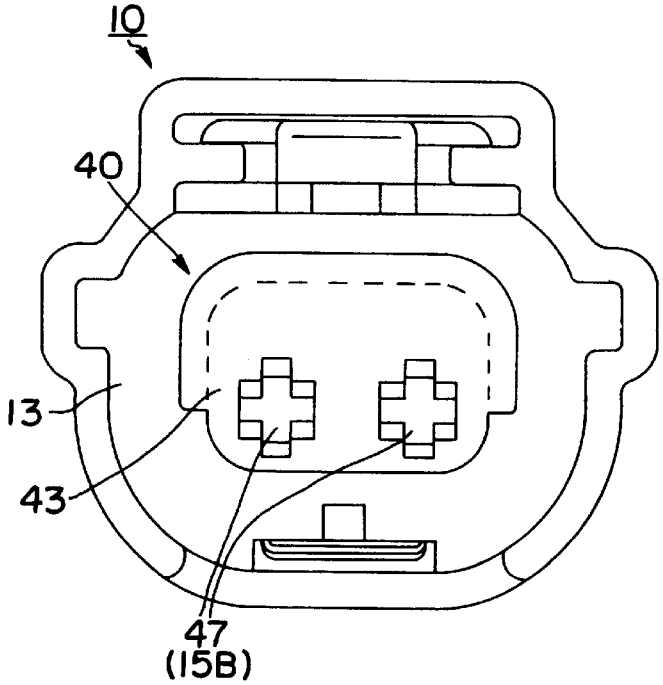
FIG. 7 is a front view of the connector when the retainer is in its full lock position.

A pair of small protuberances 44 project from side surfaces 41A of the main insertion portion 41 as shown in FIG. 5. When the retainer 40 is inserted to a position substantially immediately before where the insertion portions 41, 42 come into contact with the tapered surfaces 32, 33 (see FIG. 3), the protuberances 44 are engaged or engageable with partial lock recesses 34 formed in the inner side surfaces of the retainer insertion hole 30 (partial locking of the retainer). When the insertion portions 41, 42 are substantially inserted to the back of the respective insertion holes 30, 31 while being guided by the tapered surfaces 32, 33 (see FIG. 8), the protuberances 44 are substantially engaged or engageable with full lock recesses 35 formed in the inner side surfaces of the retainer insertion hole 30 (full locking of the retainer). Thus, the retainer 40 is not inadvertently moved or movable from the respective lock positions.

Figure 9:
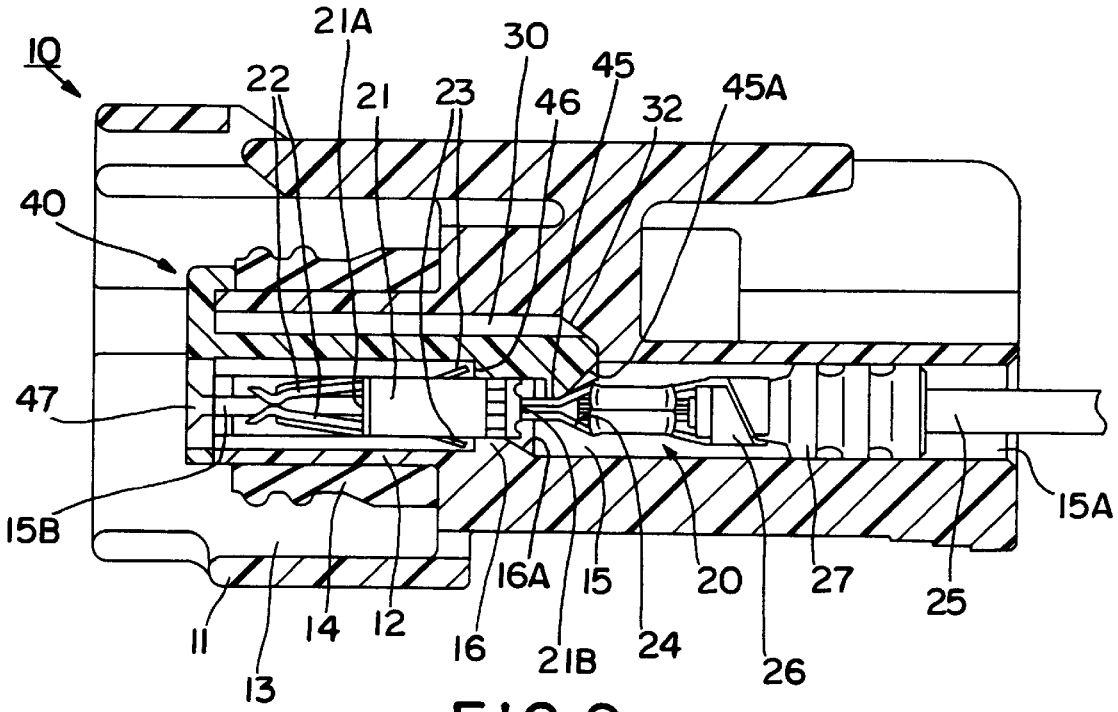
FIG. 9 is a side view in section of the connector when the retainer locks the terminal fittings so as not to come out.

At the leading end of the main insertion portion 41, a pair of lock projections 45 projects preferably substantially downward in FIG. 4. When the retainer 40 is in its partial lock position, the lock projections 45 substantially face the receiving projections 16 of the cavities 15 and the metal locking portions 23 of the terminal fittings 20 are engaged or engageable with the lock projections 45 and the receiving projections 16 as shown in FIG. 1. When the retainer 40 is in its full lock position, the lock projections 45 substantially project into the cavities 15 to substantially face the rear end surfaces 21B of the terminal base portions 21 of the terminal fittings 20 as shown in FIG. 9. A lower right corner of each locking projection 45 in FIG. 4 is cut off to form a slanted surface 45A which is inclined upward to the right i.e. in a direction toward the rear side of the connector housing 10 and away from the auxiliary insertion portion 42. When the terminal fittings 20 are inserted into the cavities 15 with the retainer 40 in its partial lock position, the metal lock portions 23 are brought substantially into contact with the slanted surfaces 45A and the rear slanted surfaces 16A of the receiving projections 16 (see FIG. 1), thereby being deformed.

A lower surface 41B of the main insertion portion 41 faces downwardly in FIG. 4 or substantially faces the auxiliary insertion portion 42. The lower surface 41B is formed with a pair of stepped surfaces 46 facing to the left of FIG. 4. The stepped surfaces 46 are provided in conformity with or corresponding to the communicating portions with the cavities 15. When the retainer 40 reaches its full lock position, the metal locking portions 23 of the terminal fittings 20 are engaged with these stepped surfaces 46 as shown in FIG. 9.

The base portion 43 preferably has a substantially rectangular cross section with rounded corners so as to conform or correspond to the shape of the front surface of the main body 12, and is formed with a pair of through holes 47 corresponding to the tab insertion openings 15B. When the retainer 40 reaches its full lock position, the tab insertion openings 15B and the through holes 47 are aligned substantially as shown in FIG. 9 so as to permit the insertion of the male tabs into the cavities 15. The base portion 43 also substantially acts as a stopper for the waterproof ring 14 by substantially facing opposite to it.

A connector producing factory and a harness producing factory where terminal fittings connected with ends of wires are assembled into connectors generally are located in separate places.

In the connector producing factory, the retainer 40 is mounted on the housing 10 in their partial lock positions by inserting the respective insertion portions 41, 42 of the retainer 40 substantially into the insertion holes 30, 31 of the housing 10. When the insertion portions 41, 42 of the retainer 40 are inserted only partially, e.g. halfway into the respective insertion holes 30, 31, the protuberances 44 of the main insertion portion 41 are engaged with the partial lock recesses 34 of the retainer insertion hole 30, thereby partially locking the retainer 40. The connectors are transported to the harness producing factory in this state.

In the harness producing factory, the terminal fittings 20 are assembled into this connector. In the connector transported to the harness producing factory, the retainer 40 is partly locked and, therefore, the lock projections 45 do not project into the cavities 15 (see FIG. 1). The terminal fittings 20 may be pushed into the cavities 15 with the connector in this state. During the insertion, the metal locking portions 23 of the terminal fittings 20 are deformed inwardly by coming into contact with the receiving projections 16 and/or the lock projections 45 of the retainer 40. When the terminal fittings 20 are pushed further, the metal locking portions 23 are restored preferably substantially to their original shape upon moving beyond the projections 16, 45, thereby lockingly engaging the projections 16, 45. At this time, the base portions 21 of the terminal fittings 20 substantially come into contact with contact walls (not shown) of the cavities 15, and thereby are positioned with respect to forward direction.

Figure 8:
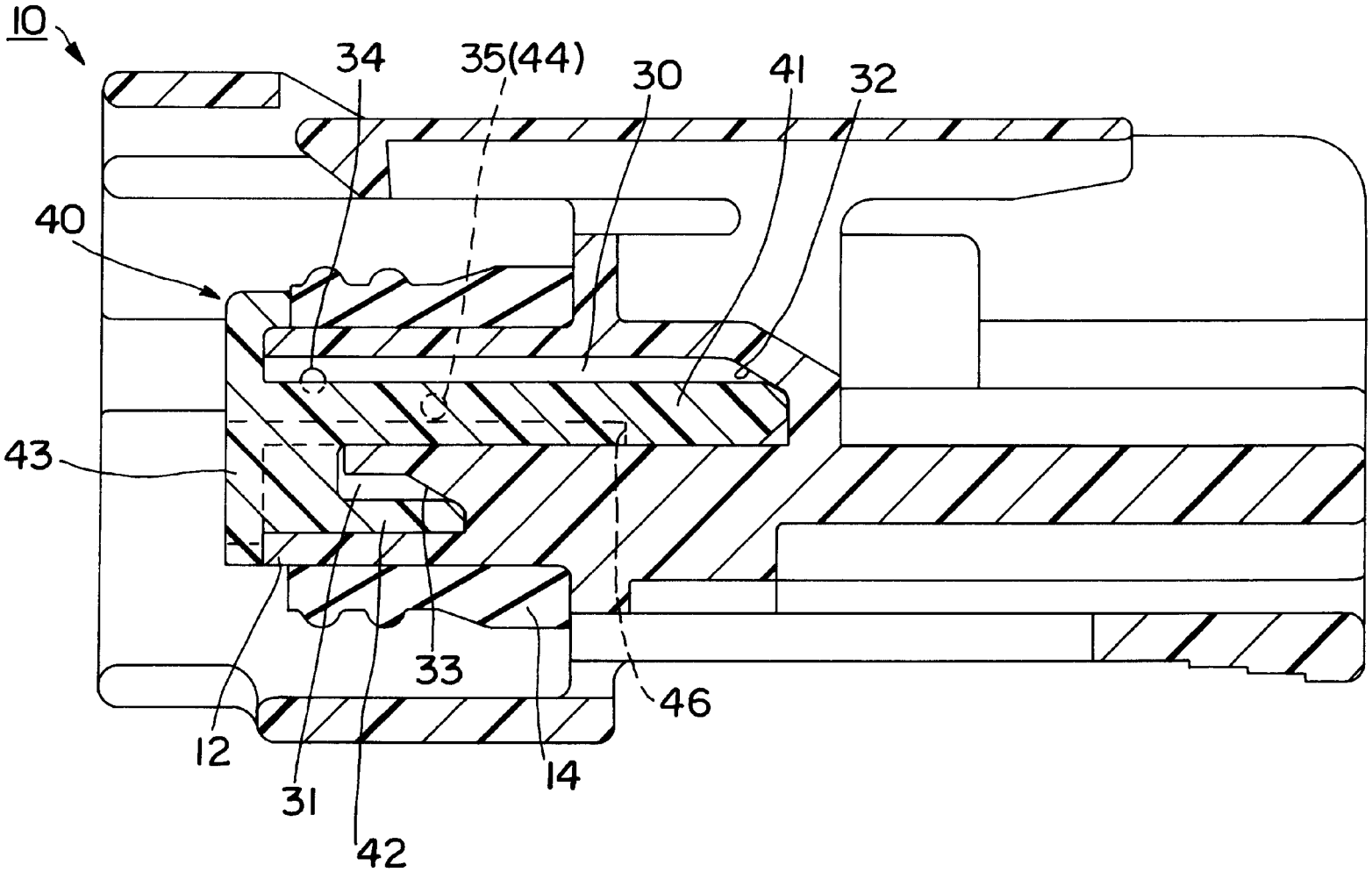
FIG. 8 is a side view in section of the connector after the retainer is guided by tapered surfaces.

In this state, the retainer 40 is pushed further toward the back. Then, the retainer 40 is moved upon the disengagement of the protuberances 44 of the main insertion portion 41 from the partial lock recesses 34. Substantially simultaneously, the respective insertion portions 41, 42 are brought obliquely into contact with the corresponding tapered surfaces 32, 33 at the back of the insertion holes 30, 31. When the retainer 40 is further pushed in this state, the leading ends of the respective insertion portions 41, 42 are guided or slide or move along the respective tapered surfaces 32, 33 and the retainer 40 is moved substantially in parallel (or not being rotated) in a direction SD at an angle different from 0° or 180° with respect to the insertion direction ID of the terminal fittings 20, preferably substantially normal to the insertion direction ID of the terminal fittings 20. In other words the retainer 40 can be shifted in a direction substantially normal to the insertion direction ID by being pushed further into the insertion holes 30, 31 and by being laterally or transversely urged by the interaction of the insertion portion(s) 41; 42 with the respective slanted or tapered guide surface 32; 33. As shown in FIG. 8, when the leading ends of the insertion portions 41, 42 are located substantially at the bottom ends of the tapered surfaces 32, 33, the base portion 43 of the retainer 40 preferably comes substantially into contact with the front surface of the housing 10 and the protuberances 44 are engaged with the full lock recesses 35. As a result, the retainer 40 is fully locked. In the connector of this embodiment, the retainer 40 is guided in two spaced-apart positions, i.e. at the leading and base ends with respect to the insertion direction of the terminal fittings 20, by the two insertion portions 41, 42 and the two tapered surfaces 32, 33. Therefore, the retainer 40 can be shifted stably.

Figure 10:
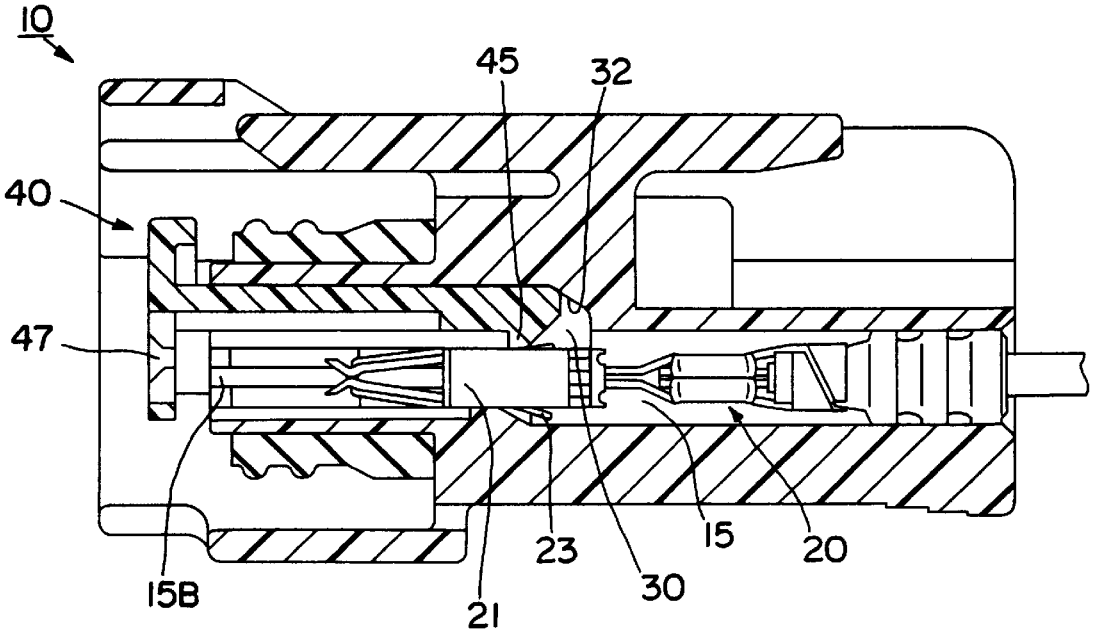
FIG. 10 is a side view in section of the connector when the terminal fittings are insufficiently inserted.

When the retainer 40 reaches its full lock position, the through holes 47 of the base portion 43 substantially align with the tab insertion openings 15B on the outside of the housing 10, thereby permitting the insertion of the tabs of the mating connector into the cavities 15 of the connector housing 10. On the other hand, inside the housing 10, the lock projections 45 of the retainer 40 face the rear end surfaces 21B of the terminal base portions 21 of the terminal fittings 20 or project into a space formed behind the terminal base portion 21 of the terminal fittings 20. As a result, the terminal fittings 20 are retained or retainable directly by the retainer 30 so as not to come out of the cavities 15. If the terminal fittings 20 are insufficiently inserted, the terminal base portions 21 of the terminal fittings 20 are located in a movable range of the lock projections 45 as shown in FIG. 10. The retainer 40 cannot be pushed to its full lock position by the interference of the terminal base portions 21. In this way, the insufficient insertion of the terminal fittings 20 can be detected.

When this connector is connected with the mating connector, the tabs of the mating connector are inserted into the cavities 15 to be electrically connected and the inside of each cavity 15 is held substantially watertight by the waterproof ring 14 between the connectors and the waterproof rubber plug 27 in the cavity 15.

As described above, according to the connector of this embodiment, the terminal fittings 20 can be retained with a larger force since they are locked or lockable directly by the retainer 40. Further, since the openings of the insertion holes 30, 31 into which the retainer 40 is inserted are located in the front surface of the housing 10, they are covered by the mating connector and are not exposed to the outside. In other words, the connector of this embodiment has advantages of both side retainer type and front retainer type connectors of prior art and can retain the terminal fittings 20 with a large force while being designed to be watertight.

Figure 11:
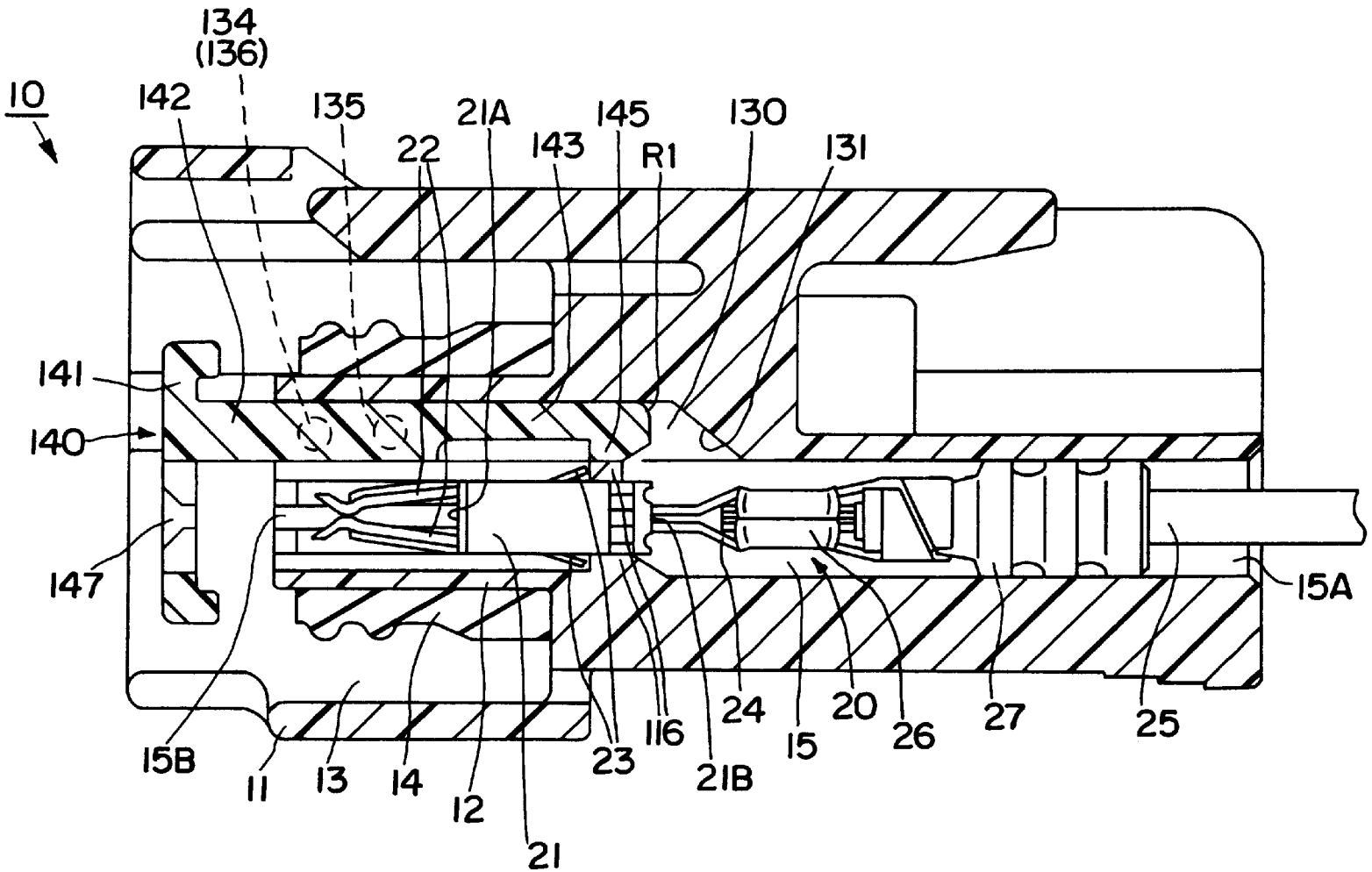
FIG. 11 is a side view in section of a connector provided with a retainer according to a second embodiment of the invention.

A second embodiment of the invention is shown in FIGS. 11 to 16. In FIG. 11, identified by 10 is a connector housing which is the same as or similar to the one of the first embodiment. Also the terminal fittings 20 are the same as or similar to the ones of the first embodiments, wherein the metal locking portions 23 are lockingly engaged or engageable with a pair of receiving portions 116 formed in the cavity 15 so as to prevent the terminal fitting 20 from coming out of the cavity 15.

Figure 12:
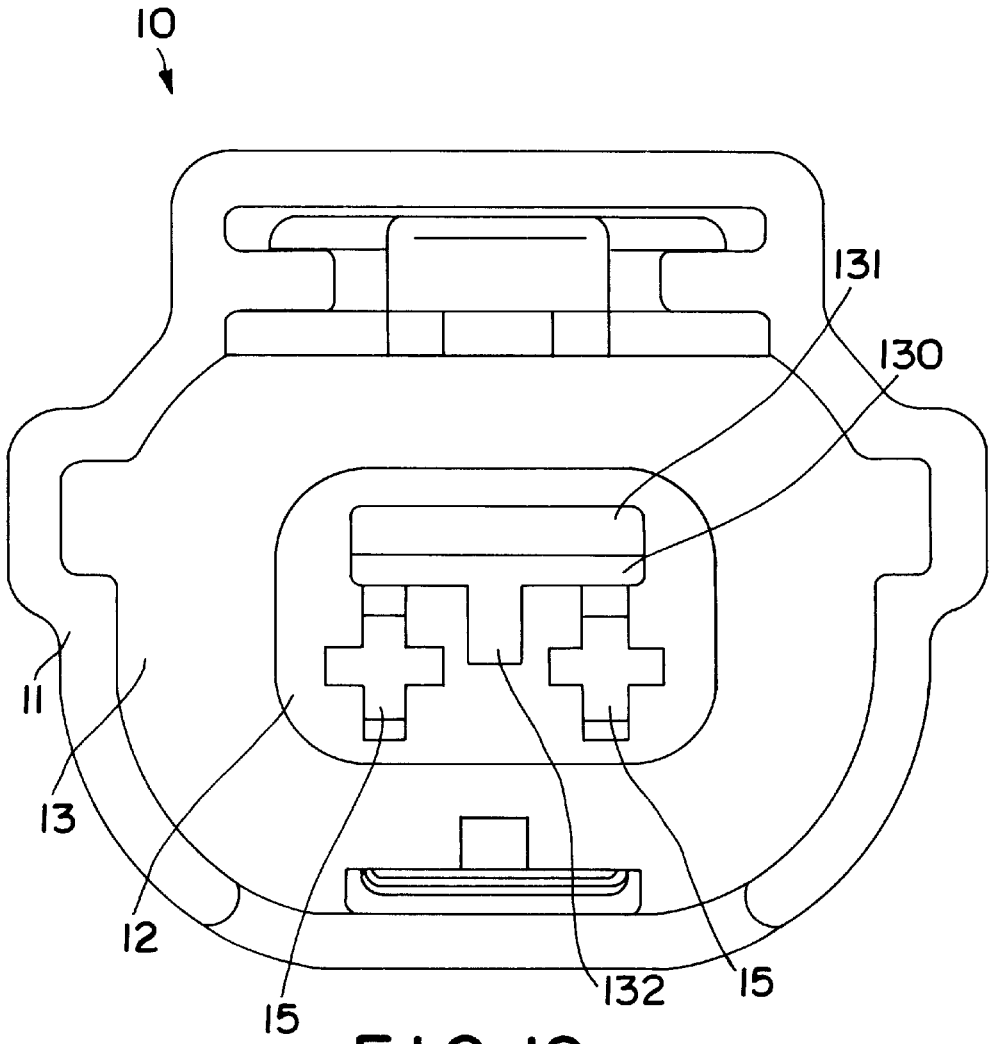
FIG. 12 is a front view of a housing of the connector.

The housing 10 is formed with a retainer insertion hole 130 that is open in the front surface of the main body 12 as shown in FIG. 12. The retainer insertion hole 130 is located substantially above the cavities 15 as shown in FIG. 12 and has a substantially rectangular cross section which is long along the transverse direction of FIG. 12. The retainer insertion hole 130 extends to an intermediate position of the housing 10 in parallel with the cavities 15 (see FIG. 11). Further, the retainer insertion hole 130 substantially communicates with the upper parts of the cavities 15 (see FIGS. 11 and 12). This communicating portion is widened at the back to avoid the interference with the locking projections 145 provided on the retainer 140. The back of the retainer insertion hole 130 is provided with a tapered surface 131 which is inclined toward the cavities 15 and toward the back as shown in FIG. 11.

Further, as shown in FIG. 12, a jig insertion hole 132 is formed between the cavities 15 and communicate with the retainer insertion hole 130 along a substantially transverse, preferably vertical direction in the main body 12.

Figure 13:
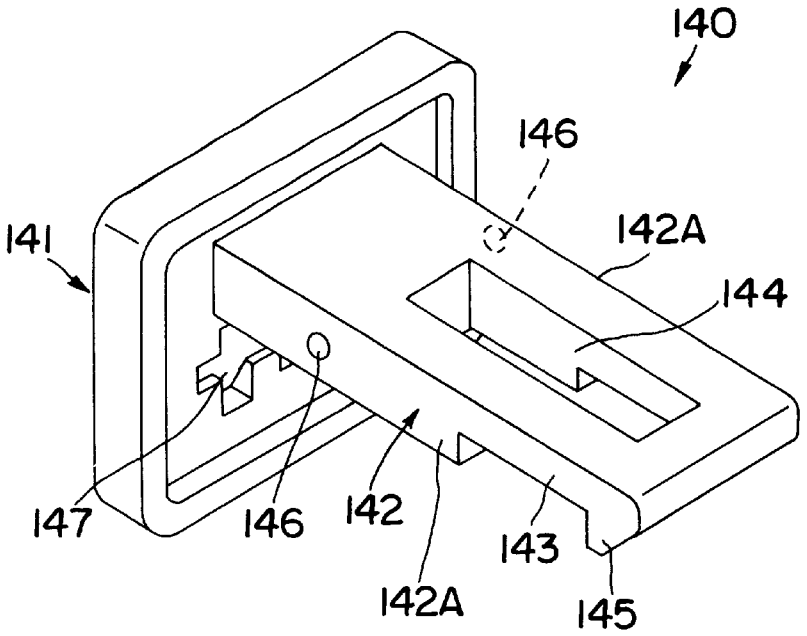
FIG. 13 is a perspective view of a retainer.
Figure 14:
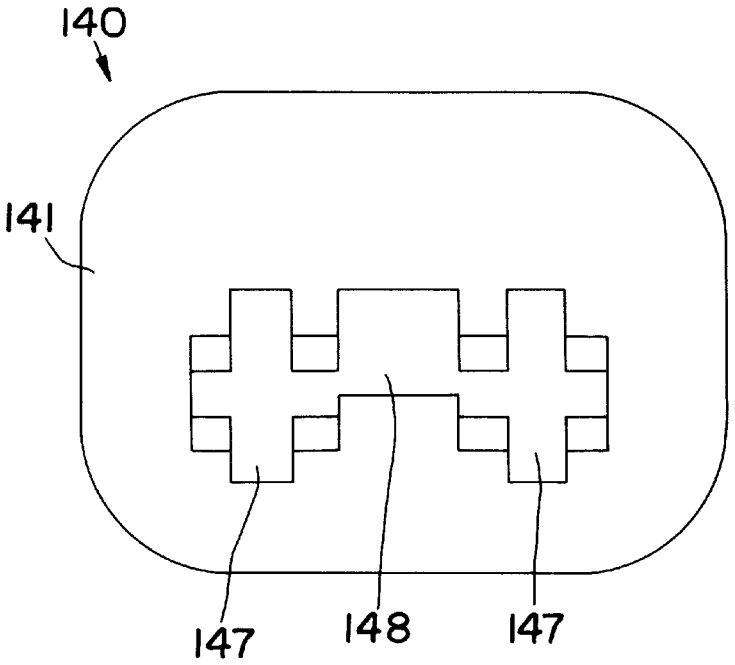
FIG. 14 is a front view of the retainer.

The retainer 140, as shown in FIG. 13, is provided with an insertion portion 142 insertable into the retainer insertion hole 130 and a base portion 141 in the form of a substantially flat plate at the rear end of the insertion portion 142. The insertion portion 142 is in the form of a substantially flat plate having substantially the same cross section as the retainer insertion hole 130. The insertion portion 142 is provided with a thinned portion 143 formed e.g. by making a recess in the lower surface thereof from an intermediate position toward its leading end along its longitudinal direction. A lock projection 145 is an unrecessed leading end of the insertion portion 142 and preferably extends substantially entirely over the width of the insertion portion 142. Further, a slit 144 is formed in the middle of the insertion portion 142 with respect to its widthwise direction and extends from an intermediate position to the lock projection 145 along the longitudinal direction, so that portions of the insertion portion 142 at the opposite sides of the slit 144 appear to be connected or bridged by the lock projection 145. The insertion portion 142 has such a length that its leading end obliquely comes into contact with the tapered surface 131 during the insertion into the retainer insertion hole 130. When the retainer 140 is further pushed in this contact state, the thinned portion 143 is deformed, thereby guiding the leading end of the insertion portion 142 to the bottom end of the tapered surface 131, with the result that the lock projection 145 projects into the cavities 15 (see FIG. 15). Further, the upper corner of the leading end of the insertion portion 142 is preferably rounded (see R1 in FIG. 11) so as to be smoothly brought into contact with the tapered surface 131.

A pair of protuberances 146 project preferably from opposite side surfaces 142A of the insertion portion 142. When the retainer 140 is inserted to a position immediately before the insertion portion 142 is brought into contact with the tapered surface 131 (see FIG. 11), the protuberances 146 are engaged with partial lock recesses 134 provided in opposite inner surfaces of the retainer insertion hole 130 (this is referred to as partial locking of the retainer 140). Further, when the retainer 140 reaches a position where the leading end of the insertion portion 142 is guided substantially to the bottom end of the tapered surface 131 (see FIG. 15), the protuberances 146 are engaged with full lock recesses 135 formed in the opposite inner side surfaces of the retainer insertion hole 130 (this is referred to as full locking of the retainer 140). Thus, the retainer 140 is not inadvertently moved from the respective lock positions.

Figure 15:
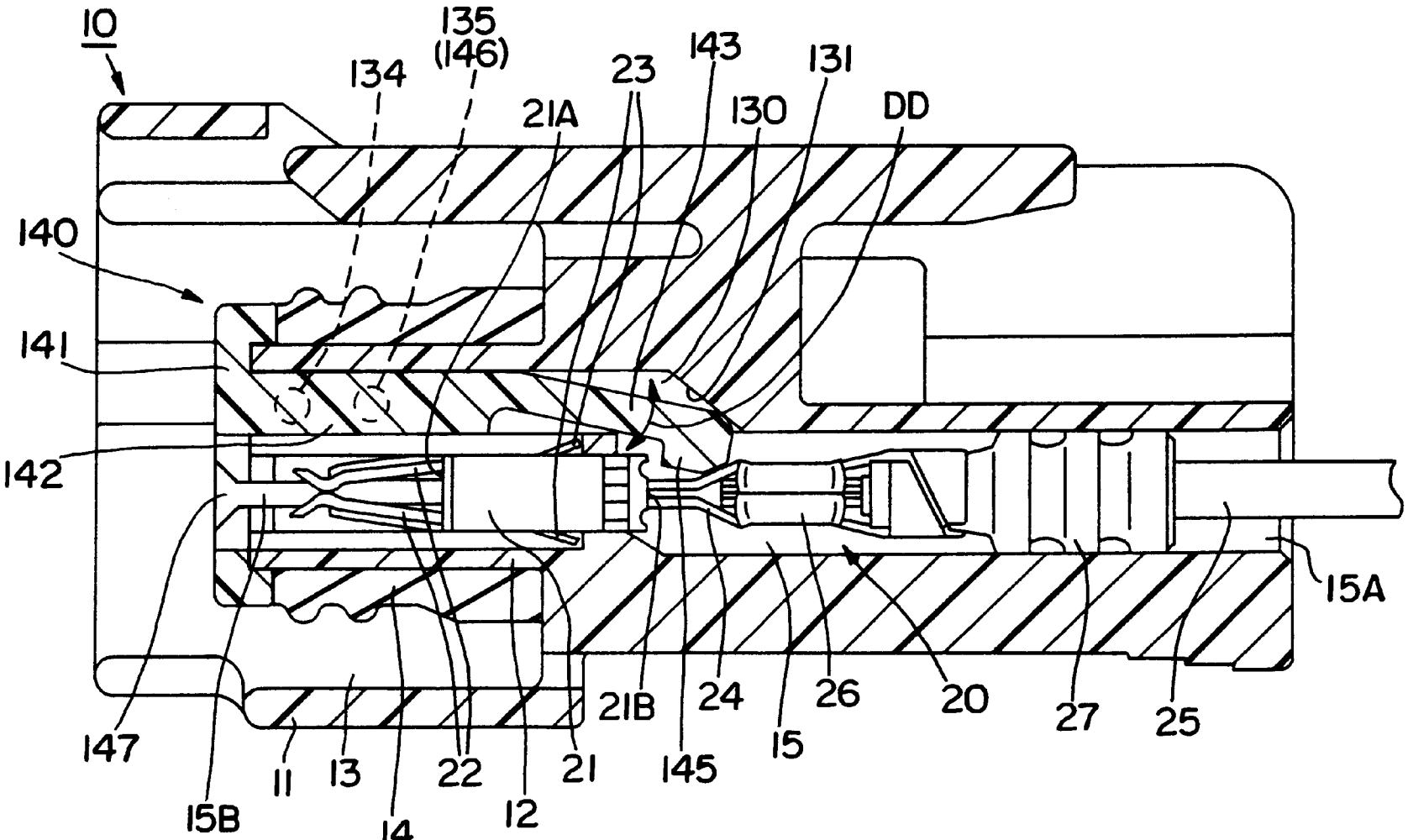
FIG. 15 is a side view in section of the connector in its fully locked state.

The base portion 141 preferably has a substantially rectangular cross section having rounded corners so as to conform to the shape of the front surface of the main body 12, and preferably slightly bulges out sideways from the main body 12 as shown in FIG. 15 to face the waterproof ring 14, thereby preventing it from being disengaged. Further, the base portion 141 is formed with a pair of through holes 147 for tabs in conformity with the tab insertion openings 15B and a through hole 148 for a jig in conformity with the jig insertion hole 132.

Generally, a connector producing factory and a harness producing factory where terminal fittings connected with ends of wires are assembled into connectors are located in separate places.

In the connector producing factory, the insertion portion 142 of the retainer 140 is inserted partway into the retainer insertion hole 130 of the housing 10 to partly lock the retainer 140 with the housing 10. The protuberances 146 of the insertion portion 142 then are engaged with the partial lock recesses 134 of the retainer insertion hole 130, thereby partially locking the retainer 140. The connectors are transported to the harness producing factory preferably in this state.

In the harness producing factory, the terminal fittings 20 are assembled into this connector. In the connector transported to the harness producing factory, the retainer 140 is partly locked and, therefore, the lock projection 145 does not project into the cavities 15 (see FIG. 11). The terminal fittings 20 may be pushed into the cavities 15 with the connector in this state. During the insertion, the metal locking portions 23 of the terminal fittings 20 are deformed inwardly by coming into contact with the receiving portions 116. When the terminal fittings 20 are further pushed, the metal locking portions 23 are restored substantially to their original shape upon moving beyond the receiving portions 116, thereby lockingly engaging the receiving portions 116. At this time, the base portions 21 of the terminal fittings 20 substantially come into contact with contact walls (not shown) of the cavities 15, thereby are positioned with respect to forward direction.

Figure 16:
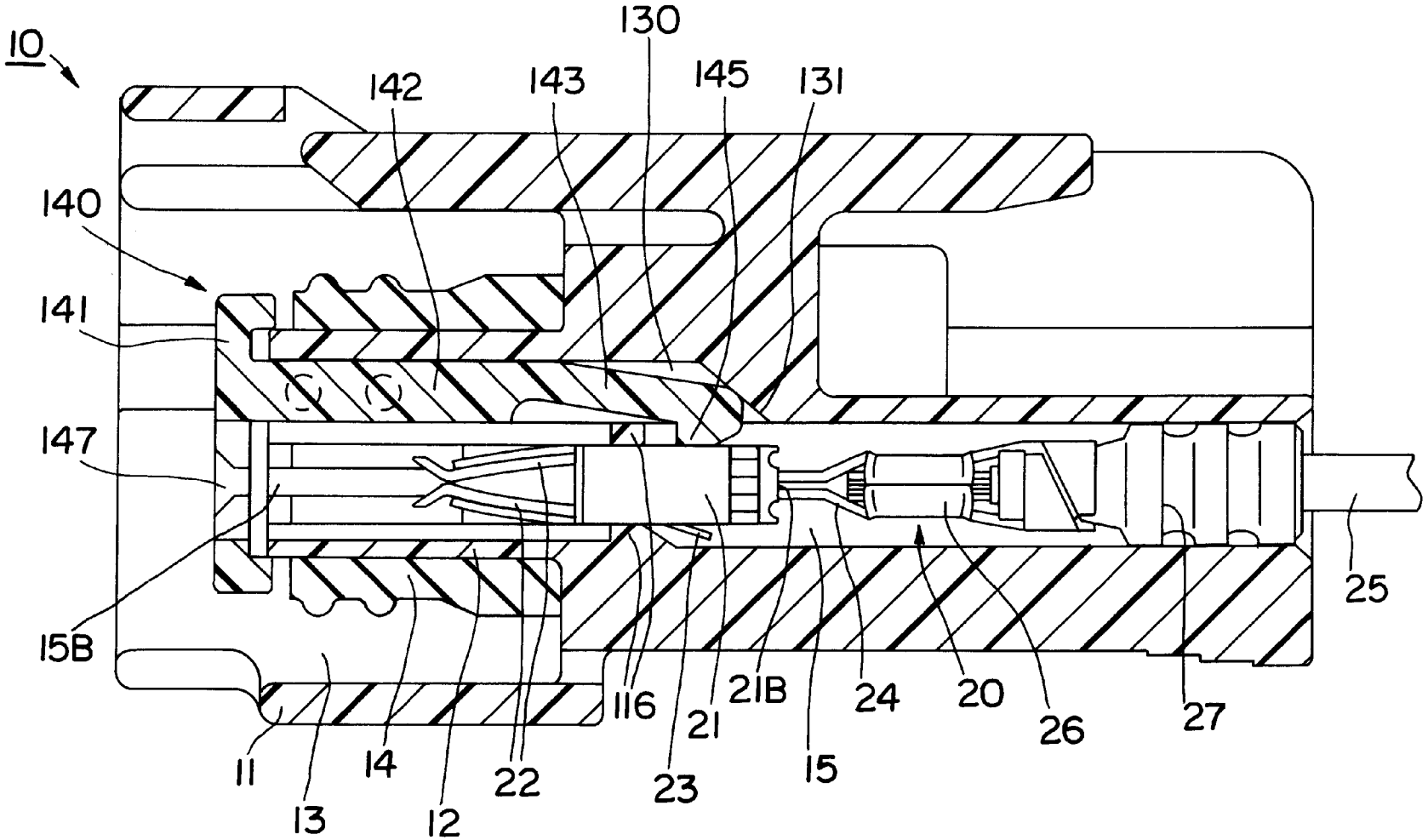
FIG. 16 is a side view in section of the connector when terminal fittings are insufficiently inserted.

In this state, the retainer 140 is pushed further toward the back. Then, the retainer 140 is moved to the back upon the disengagement of the protuberances 146 of the insertion portion 142 from the partial lock recesses 134 and the leading end of the insertion portion 142 is substantially obliquely (or under an angle between 0° and 90°) brought into contact with the tapered surface 131 of the retainer insertion hole 130. When the retainer 140 is pushed further in this state, the thinned portion 143 of the insertion portion 142 is substantially deformed or deflected in a deflection direction DD, thereby inclining the leading end of the insertion portion 142 toward the cavities 15 and guiding it in a direction toward or to the bottom end of the tapered surface 131. As a result, the base portion 141 of the retainer 140 comes into abutment against the front surface of the housing 10 and the protuberances 146 are engaged with the full lock recesses 135 to fully lock the retainer 140. In this fully locked state, the lock projection 145 of the retainer 140 projects into the cavities 15 to substantially face the rear end surfaces 21B of the terminal base portions 21, with the result that the terminal fittings 20 are directly locked by the retainer 140 so as not to come out of the cavities 15. Here, if the terminal fittings 20 are left insufficiently inserted, the terminal base portions 21 of the terminal fittings 20 are located in a movable range of the lock projection 145 as shown in FIG. 16 to interfere the lock projection 145, making it impossible to push the retainer 140 to its full lock position. Therefore, the insufficient insertion of the terminal fittings 20 can be detected.

When this connector is connected with the mating connector, the tabs of the mating connector are inserted into the cavities 15 to be electrically connected and the inside of each cavity 15 preferably is held watertight by the waterproof ring 14 between the connectors and the waterproof rubber plug 27 in the cavity 15.

As described above, according to the connector of this embodiment, the terminal fittings 20 can be retained with a larger force since they are directly locked by the retainer 140. Further, since the opening of the retainer insertion hole 130 into which the retainer 140 is inserted is located in the front surface of the housing 10, it is covered by the mating connector and is not exposed to the outside. In other words, the connector of this embodiment has advantages of both side retainer type and front retainer type connectors of the prior art and can retain the terminal fittings 20 with a large force while being designed to be watertight.

To detach the terminal fittings 20 from the connector in the fully locked state, a specified jig is first inserted into the jig insertion hole 132 (see FIG. 12) to withdraw the retainer 140 while lifting the leading end of the retainer 140 in an upward direction of FIG. 15. Subsequently, a specified jig is inserted into the tab insertion opening 15B to withdraw the terminal fitting 20 while deforming the metal locking portion 23 downwardly.

Figure 17:
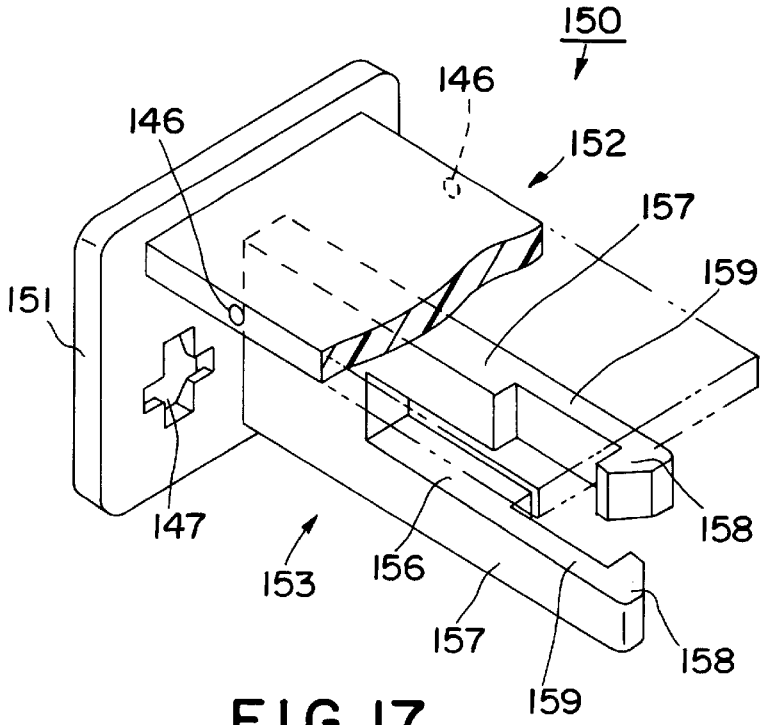
FIG. 17 is a perspective view of a retainer according to a third embodiment.

A retainer 150 according to a third embodiment of the invention is shown in FIG. 17 and is constructed such that first and second insertion portions 152, 153 project substantially in parallel from a base portion 151 which is in the form of a flat plate.

Figure 18:
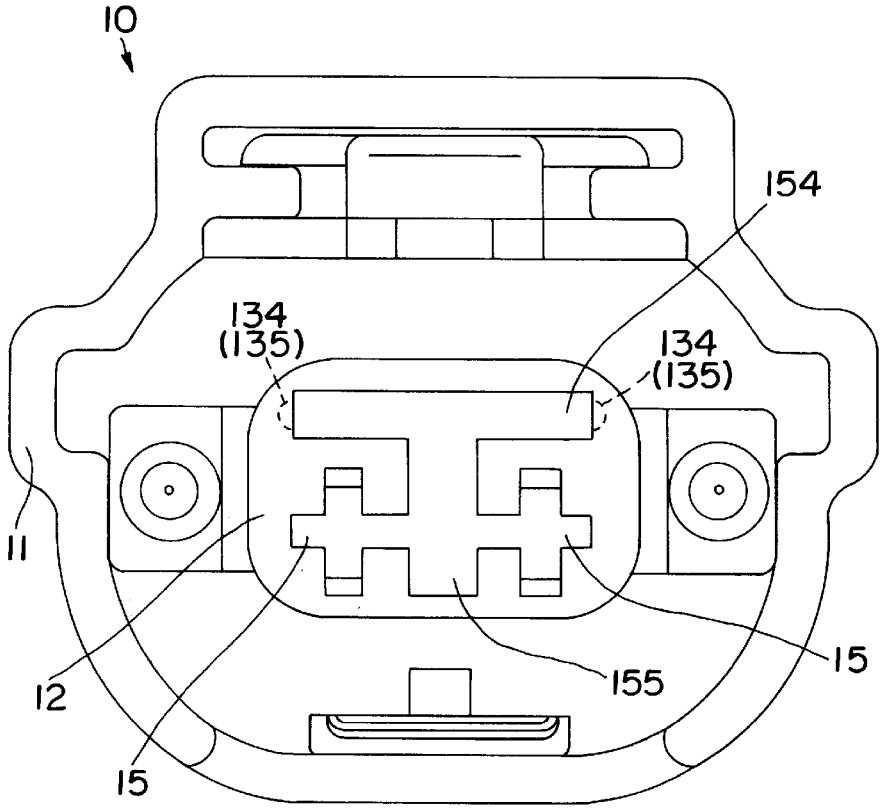
FIG. 18 is a front view of a connector housing of the third embodiment.
Figure 19:
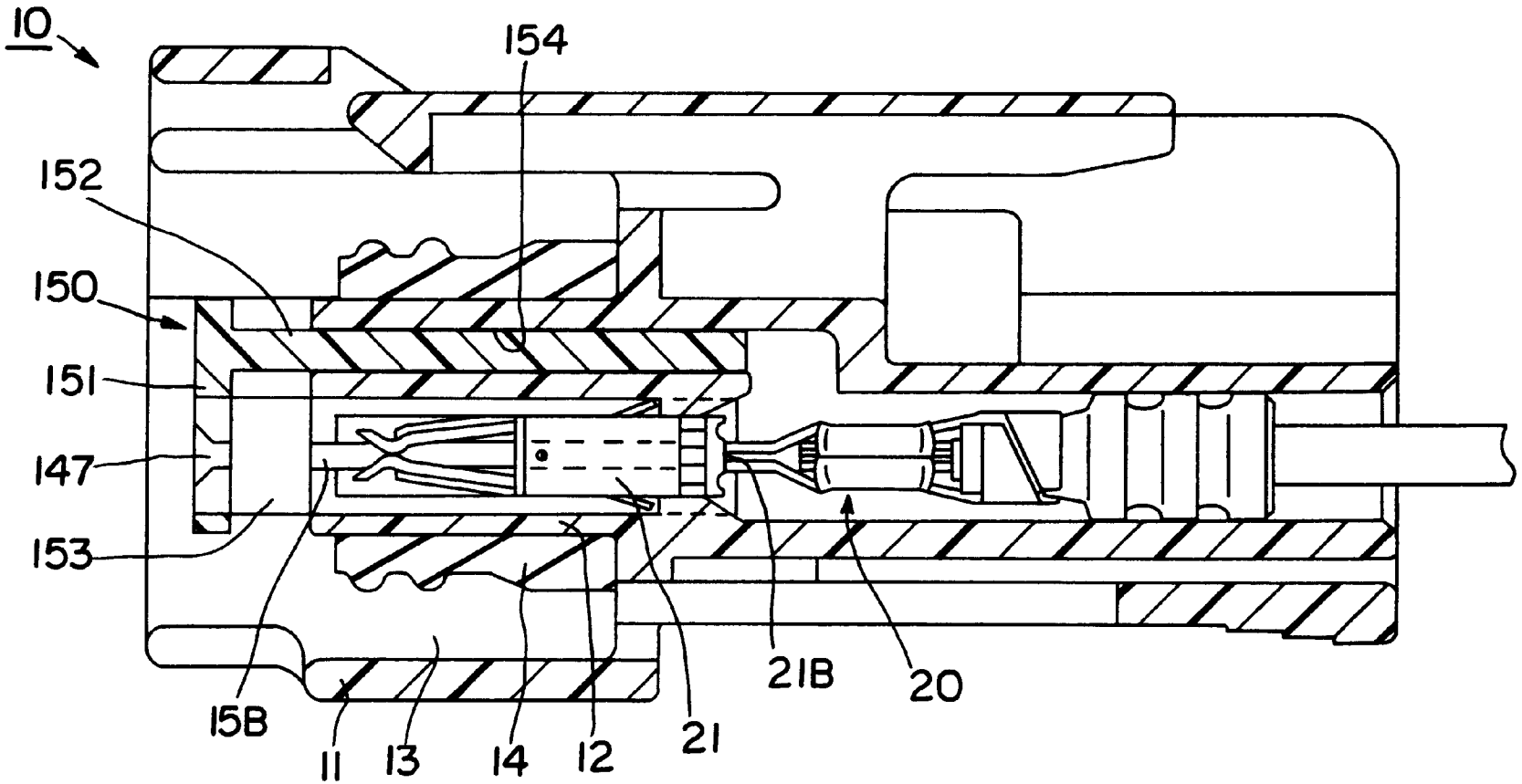
FIG. 19 is a side view in section of the retainer in its partly locked state.

The first insertion portion 152 is arranged at an upper part of the base 151 and extends along a first plane which preferably is substantially horizontal and is insertable into a first insertion hole 154 (see FIGS. 18 and 19) provided at upper portions of cavities 15 of a main portion 12 of a housing 10.

On the other hand, the second insertion portion 153 is arranged in the middle with respect to the widthwise direction of the base portion 151 and extends along a second plane arranged at an angle different from 0° or 180° with respect to the first plane, and preferably a substantially vertical plane. The second insertion portion 153 is insertable into a second insertion hole 155 (see FIGS. 18 and 20) provided between the cavities 15 of the main body 12 of the housing 10. The second insertion portion 155 is formed with a slit 156 which extends from an intermediate position with respect to the longitudinal direction thereof to the leading end thereof. Portions of the second insertion portion 155 above and below the slit 156 serve as a pair of split pieces 157. The split pieces 157 correspond to left and right cavities 15 and each are formed with a thinned portion 159 by recessing a surface facing the corresponding cavity 15. At the leading end of each split piece 157 is formed a lock projection 158 which projects toward the corresponding cavity 15 and is capable of locking the corresponding terminal fitting 20.

Figure 20:
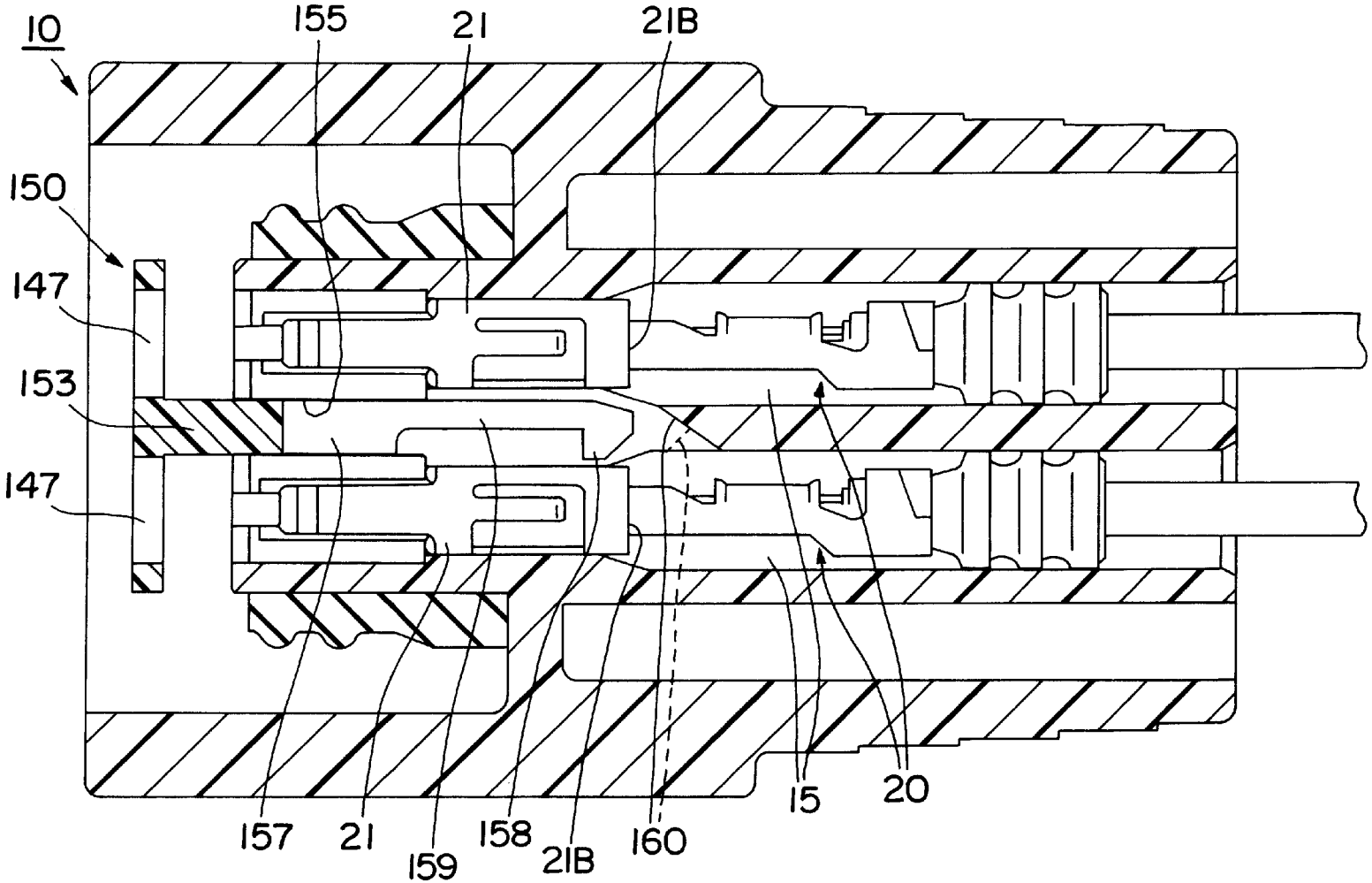
FIG. 20 is a plan view in section of the retainer in its partly locked state.

At the back of the second insertion hole 155, a pair of upper and lower tapered surfaces 160 are provided in conformity with the respective split pieces 157 as shown in FIG. 20. The tapered surfaces 160 are inclined toward the corresponding cavities 15 toward the back of the second insertion hole 155. Since the other construction is same as the second embodiment, no repetitive description is given thereon by identifying it by the same reference numerals.

Figure 21:
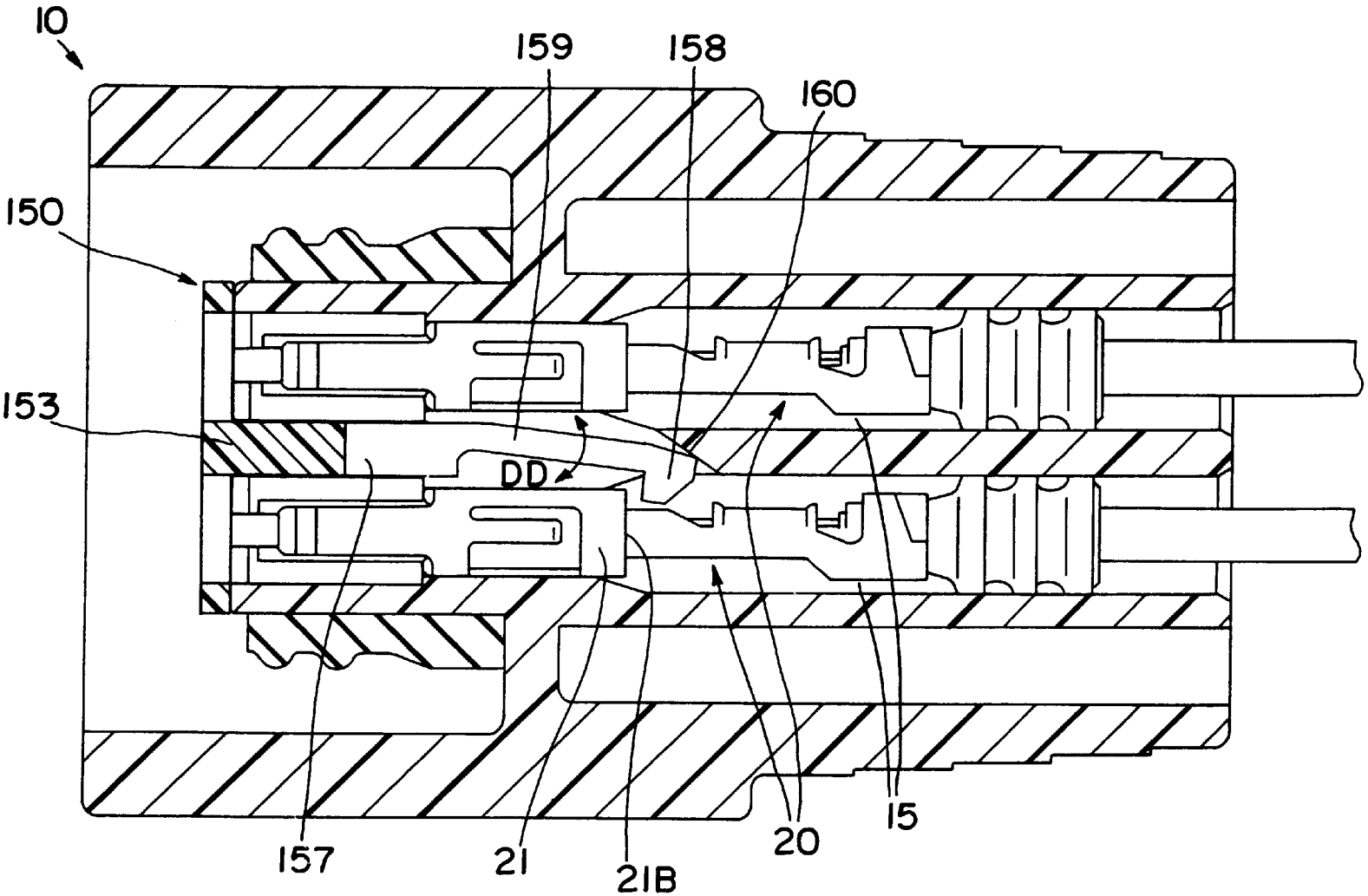
FIG. 21 is a plan view in section of the retainer in its fully locked state.

When the connector of this embodiment is pushed from a partial lock position shown in FIG. 20 to a full lock position shown in FIG. 21, the respective split pieces 157 obliquely (or under an angle between 0° and 90°) are brought into contact with the tapered surfaces 160, thereby are deformed elastically or deflected in opposite deformation or deflection directions DD. Then, the lock projections 145 of the split pieces 157 project into the cavities 15 to directly face the rear end surfaces 21B of the terminal base portions 21, thereby locking the terminal fittings 20. As described above, the split pieces 157 are deformed elastically in opposite directions according to this embodiment. Accordingly, the retainer 150 can stably be inserted into the housing 10 while the elastic counterforces of the split pieces 157 are substantially cancelled.

Figure 22:
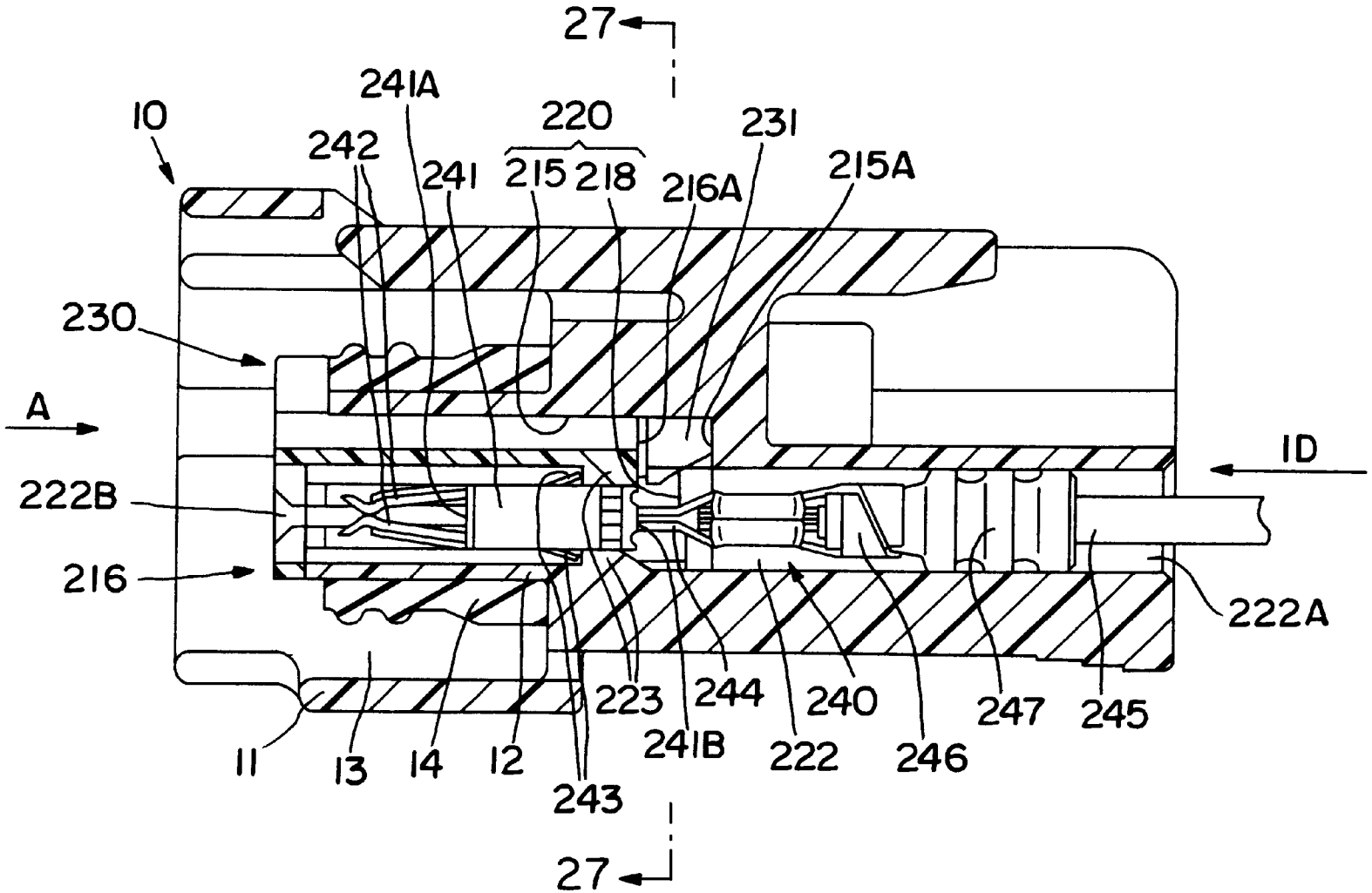
FIG. 22 is a side view in section of a connector provided with a retainer according to a fourth embodiment of the invention.

A fourth embodiment of the invention is described with reference to FIGS. 22 to 31, and has a connector housing 10. A left end surface of the housing 10 in FIG. 22 is a front surface to be engaged with a mating connector (not shown). A receptacle of the mating connector is fitted into a space 13 between a receptacle 11 projecting substantially forward from the front surface of the housing 10 and a main body 12 inside it for the connection of the two connectors. Further, a waterproof ring 14 is preferably fitted on the outer surface of the main body 12 and is brought or bringable into sealing contact with the inner surface of the mating receptacle and the outer surface of the main body 12 by being compressively deformed therebetween.

As shown in FIG. 22, the main body 12 is formed with an inner insertion hole 215 which is open in the front surface of the main body 12. An inner housing 216 is insertable into this inner insertion hole 215. The inner housing 216 is provided with a jaw portion 217 at its rear end with respect to its insertion direction into the inner insertion hole 215, and is locked therein by an unillustrated locking means while the jaw portion 217 substantially abuts against the front surface of the main body 12. Further, as shown in FIG. 22, a leading end surface 216A of the inner housing 216 with respect to the insertion direction and a back surface 215A of the inner insertion hole 215 are spaced apart by a specified distance. This clearance serves as a back space 218 in which lock projections 231 provided on a retainer 230 to be described later can be accommodated.

Figure 23:
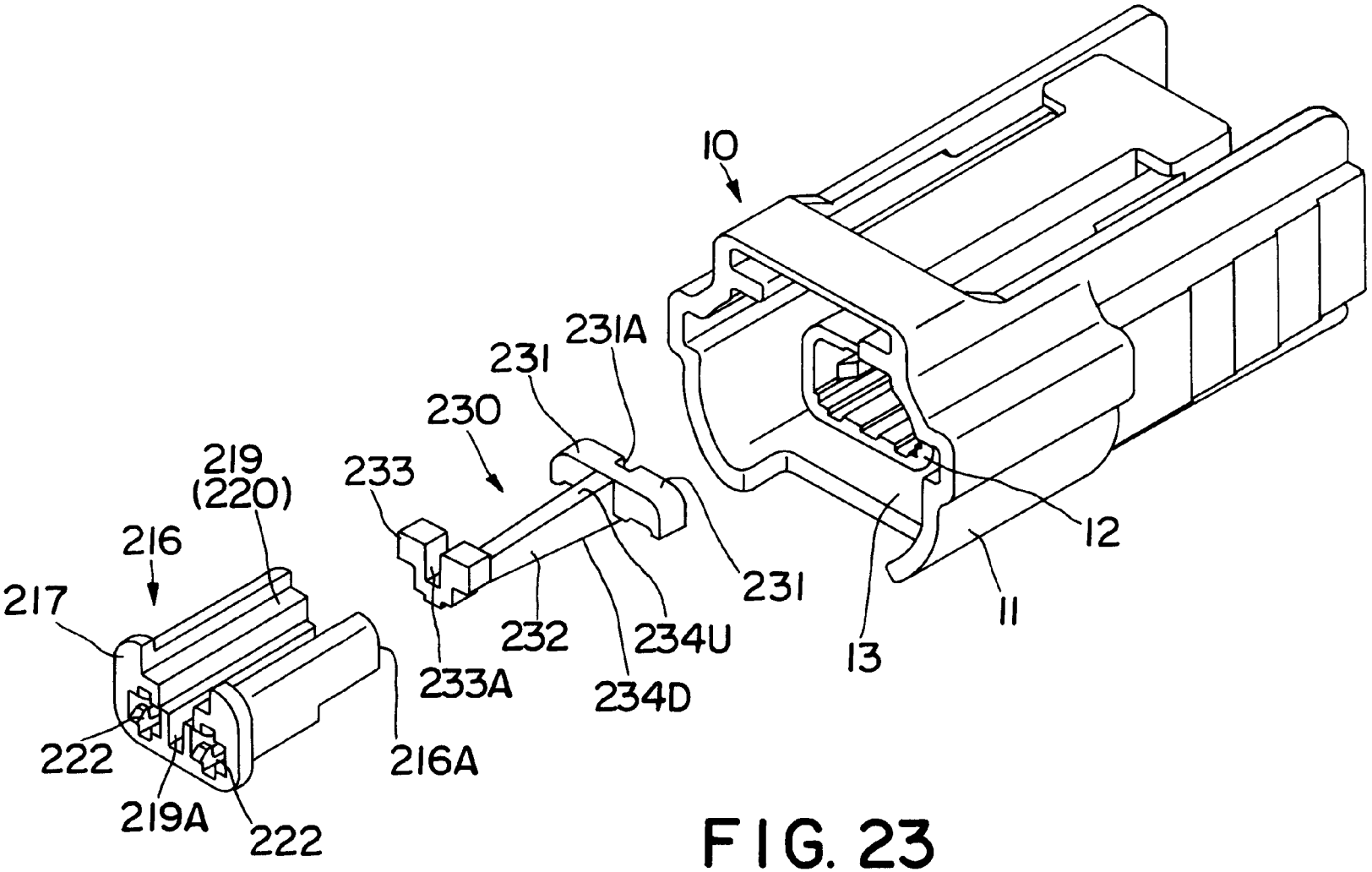
FIG. 23 is an exploded perspective view of the connector.

As shown in FIG. 23, the inner housing 216 is formed with a groove 219 which is open in the upper and opposite end surfaces of the inner housing 216 and extends along the insertion direction. The middle of the groove 219, with respect to its widthwise direction, is recessed substantially rectangularly to form a narrow bottom portion 219A. A retainer insertion hole 220 for accommodating the retainer 230 constructed or defined substantially by a space enclosed by the inner walls of the groove 219, and the inner walls of the inner insertion hole 215 and the back space 218 (see FIG. 22) substantially communicate with this space. In the inner housing 216, a pair of cavities 222, to be described next, extend substantially parallel with the retainer insertion hole 220 at the opposite sides of the bottom portion 219A of the groove 219.

The housing 10, as shown in FIG. 22, is formed with the pair of cavities 222 (only one is shown in FIG. 22) which extend substantially along the engaging direction with the mating connector entirely through the main body 12 and the inner housing 216. Terminal fittings 240 are inserted in an insertion direction ID through rear openings 222A of the cavities 222 at the rear side (right side in FIG. 22), which is the side opposing to the mating side at which the mating connector (not shown) is connected to the connector housing 10. The terminal fittings 240 of the housing 10 are electrically connected or connectable with male tabs (not shown) of the mating connector to be inserted through front openings 222B of the cavities 222. The cavities 222 substantially communicate with the back space 218 in their intermediate positions.

The terminal fittings 240 are formed as shown in FIG. 22 preferably by successively cutting a conductive metal plate and bending the cut pieces. A front end surface 241A of a terminal base portion 241, substantially in the form of a rectangular parallelepiped, is brought into contact with a contact wall (not shown) formed in the cavity 222, thereby positioning the terminal fitting 240 in the cavity 222 with respect to forward direction. A pair of opposite pieces 242 extend forwardly in directions toward each other from the front end surface 241A of the terminal base portion 241, and the male tab of the mating connector is substantially held between these opposite pieces 242 to establish an electrical connection. Further, a pair of metal lances or locking portions 243 extend obliquely or under an angle different from 0° or 180°, and preferably backwardly, from opposite side walls of the terminal base portion 241. These metal locking portions 243 lockingly engage with receiving projections 223 formed in the cavity 222 to prevent the terminal fitting 240 from coming out of the cavity 222.

A barrel portion 246 is formed on a rear end surface 241B of the terminal base portion 241. The barrel portion 246 has a raised portion 244 extending backward from a center portion of the rear end surface 241B and is adapted to connect to a leading end of a wire 245. When the terminal fitting 240 is inserted to its proper position, the raised portion 244 is located in a communicating portion of the cavity 222 with the back space 218. An end of the wire 245 and a waterproof rubber plug 247 preferably are connected with the barrel portion 246 as shown in FIG. 22, and this waterproof rubber plug 247 is in sealing contact with an external sheath of the wire 245 and the inner surface of the cavity 222.

The retainer 230 is shown entirely in FIG. 23 and is constructed such that a restricting projection 233 is provided at one end of a base portion 232 preferably in the form of a substantially flat plate extending substantially along the extension of the groove 219 of the inner housing 216 and a pair of lock projections 231 are provided at the other end thereof. The retainer 230 is or can be accommodated in the retainer insertion hole 220 with the restricting projection 233 located at the open side of the retainer insertion hole 220 and the lock projections 231 located at the side of the back space 218 of the retainer insertion hole 220. The retainer 230 is slidable along a sliding direction SD between a terminal fitting non-lock position (see FIGS. 25 to 27) of the retainer insertion hole 220 at an upper side of FIG. 22 and a terminal fitting lock position (see FIGS. 28 to 29) of the retainer insertion hole 220 at a lower side of FIG. 22.

Figure 25:
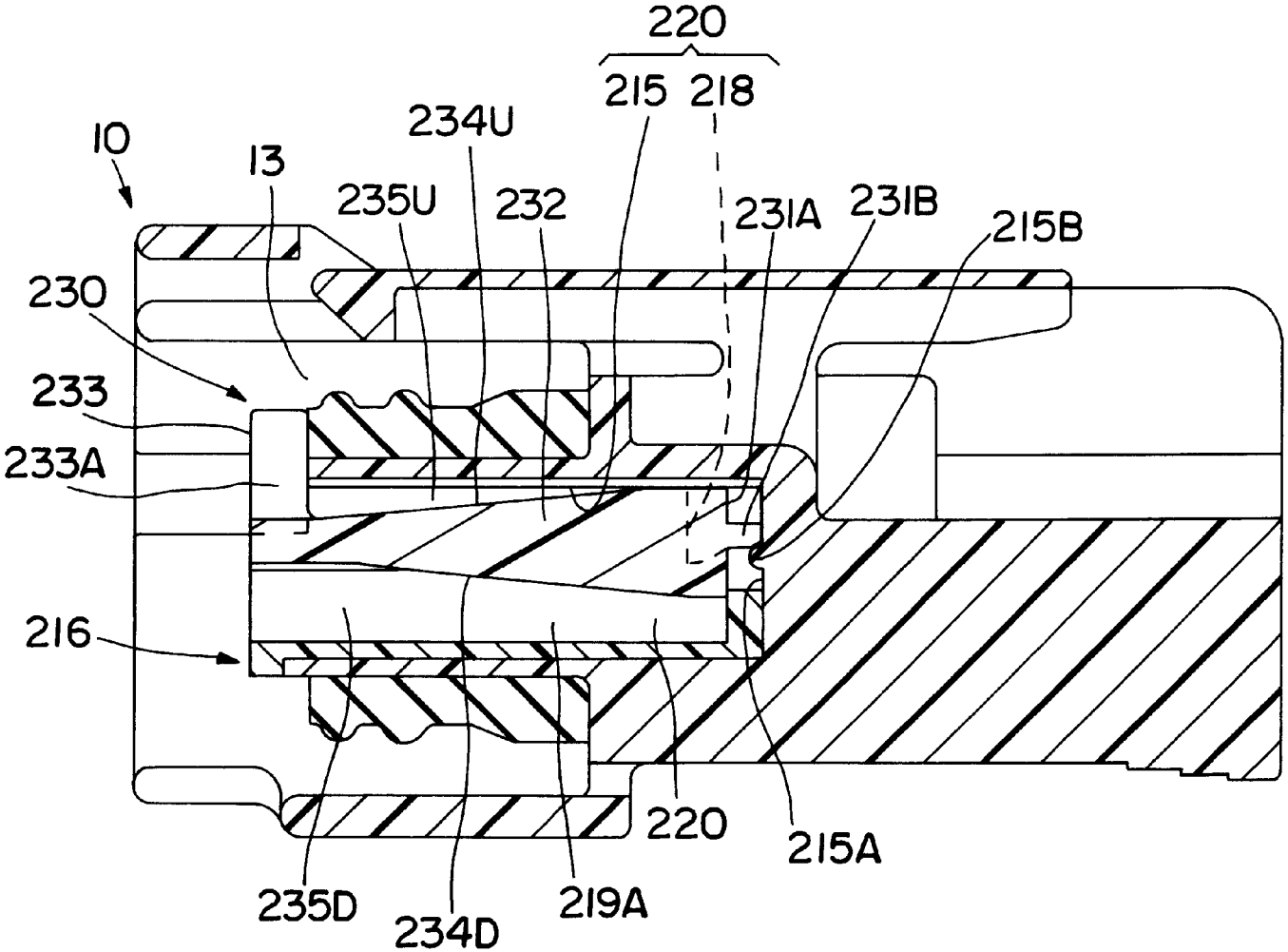
FIG. 25 is a side view in section showing the inside of a retainer insertion hole when a retainer is in a terminal fitting non-lock position.

The base portion 232 has such a thickness as to be fittable into the bottom portion 219A of the groove 219, and the upper and lower surfaces thereof in FIG. 25 are formed into tapered surfaces 234U, 234D which gradually become closer to or approach the inner walls of the retainer insertion hole toward the back of the retainer insertion hole 220. Clearances between the respective tapered surfaces 234U, 234D and the inner walls of the retainer insertion hole 220 serve as jig insertion spaces 235U, 235D into which a specified jig is insertable.

Figure 26:
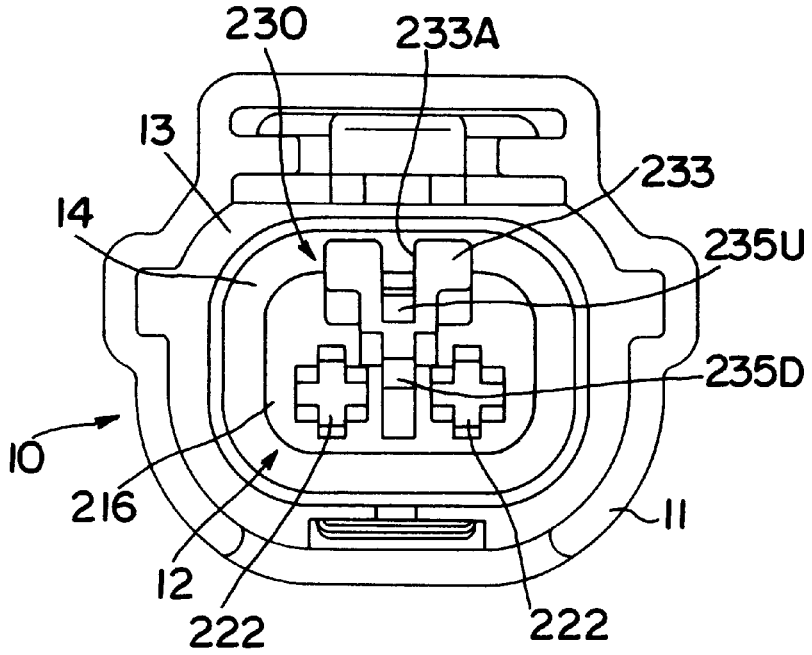
FIG. 26 is a view of the connector when viewed in a direction of arrow A of FIG. 22.
Figure 27:
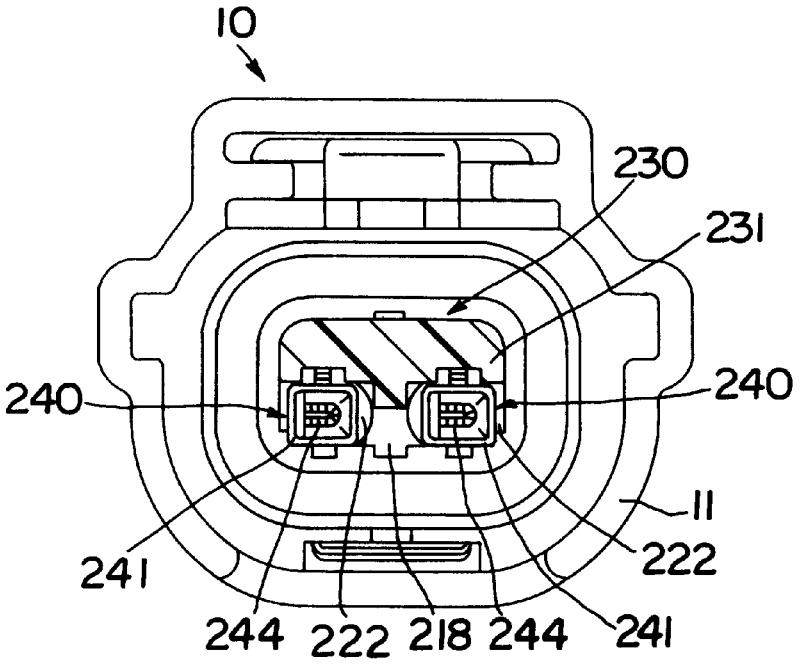
FIG. 27 is a section along 27—27 of FIG. 22.
Figure 30:
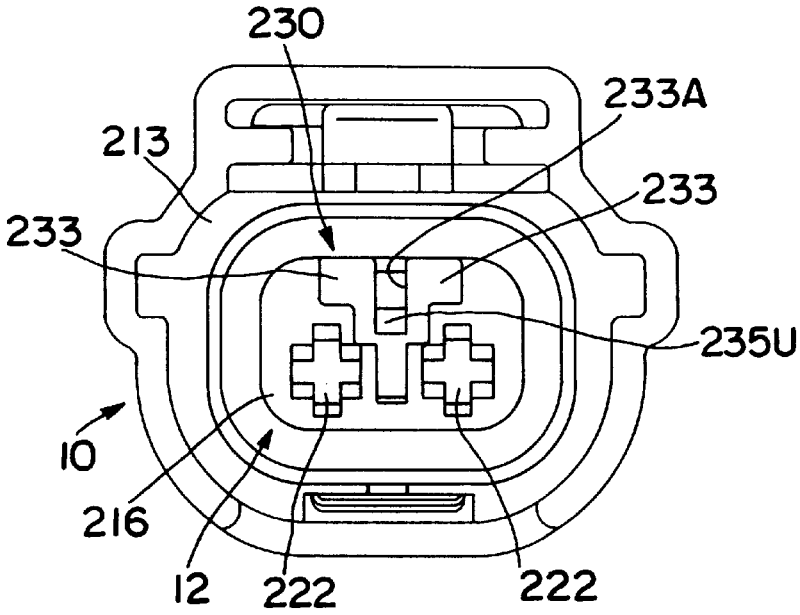
FIG. 30 is a view of the connector when viewed in a direction of arrow C of FIG. 28.
Figure 31:
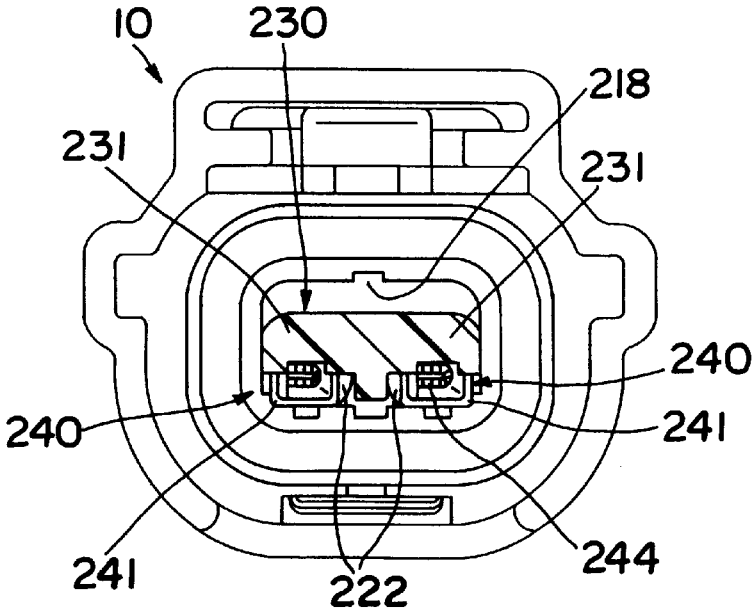
FIG. 31 is a section along 31—31 of FIG. 28.

The restricting projection 233 has a stepped transversal shape substantially conforming with or corresponding to the cross section of the groove 219. The restricting projection 233 projects upward from the base portion 232 as shown in FIG. 23. A slit 233A opens upwardly and is formed in the middle of the restricting projection 233. As shown in FIG. 26, the upper tapered surface 234U is exposed to the outside of the retainer insertion hole 220 via the slit 233A. When the retainer 230 is in its non-lock position, the restricting projection 233 projects into the space 13 from the main body 12 of the housing 10 as shown in FIG. 26, thereby preventing the insertion of a receptacle of the mating connector. When the retainer 230 is in its lock position, the restricting projection 233 substantially does not project into the space 13 as shown in FIG. 30, thereby permitting the insertion of the mating receptacle into the space 13.

Figure 28:
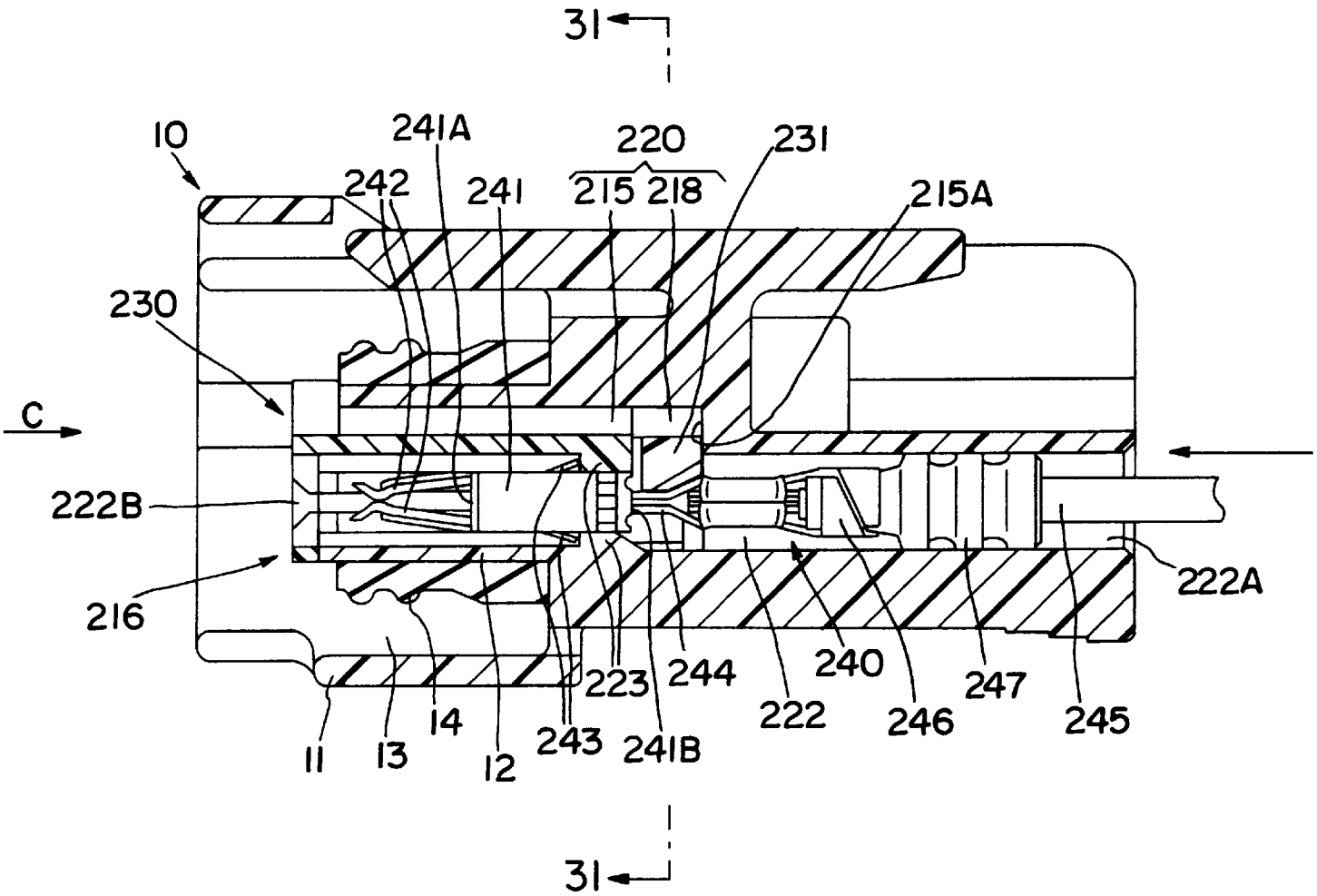
FIG. 28 is a side view in section showing the inside of a cavity when the retainer is in a terminal fitting lock position.
Figure 29:
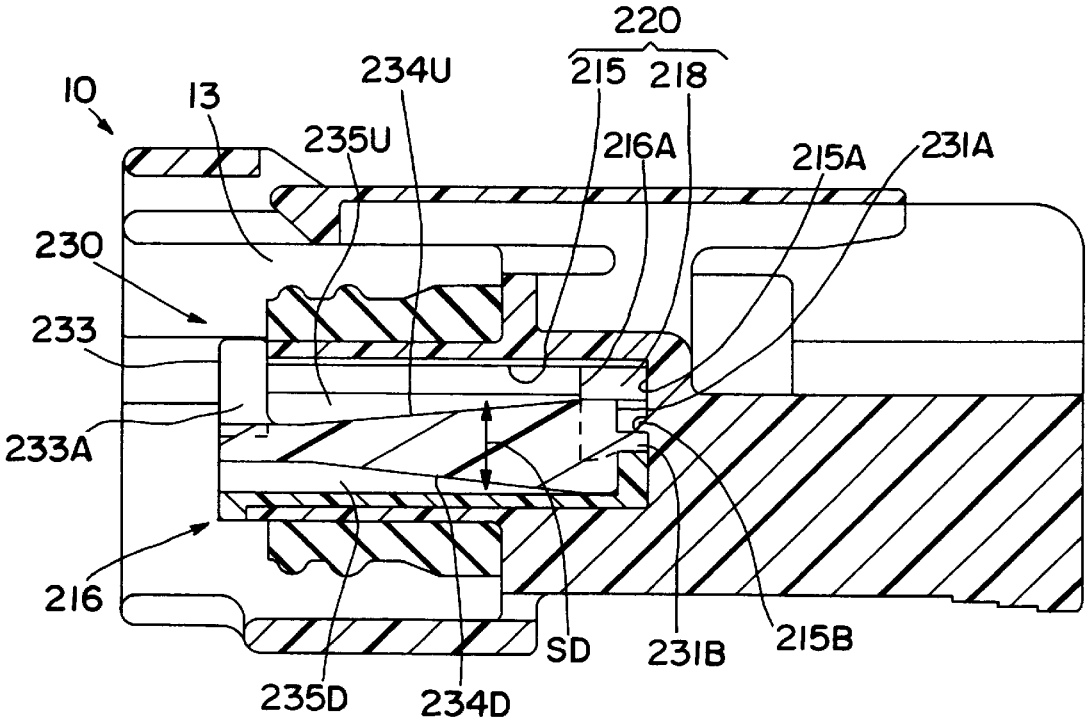
FIG. 29 is a side view in section showing the inside of the retainer insertion hole.

The lock projections 231 project substantially sideways from the base portion 232 in opposite directions, and a distance between the leading ends of the lock projections 231 is set substantially larger than the width of the groove 219. Accordingly, the lock projections 231 can lockingly engage the end surface 216A of the inner housing 216 and the retainer 230 is or can be so held in the housing 10 as not to come out. When the retainer 230 is in its lock position, the lock projections 231 substantially project into the cavities 222 from the back space 218 as shown in FIG. 28 to face the rear end surfaces 241B of the terminal fittings 240. On the other hand, when the retainer 230 is in its non-lock position, the lock projections 231 are accommodated in the back space 218 and, therefore, substantially do not face the rear end surfaces 241B of the terminal fittings 240.

A recess 231A is formed in the surfaces of the lock projections 231 facing the back surface 215A of the inner insertion hole 215 (see FIGS. 22 and 23). A lock protuberance 231B is formed in the recess 231A as shown in FIG. 25. The retainer 230 is held in its non-lock position (see FIG. 25) and lock position (see FIG. 29) by the engagement of the lock protuberance 231B and a receiving protuberance 215B provided on the back surface 215A of the inner insertion hole 215, and is not inadvertently moved from these positions.

Generally, a connector producing factory and a harness producing factory where terminal fittings connected with ends of wires are assembled into connectors are located in separate places.

In the connector producing factory, the housing 10, the inner housing 216 and the retainer 230 are assembled as follows. First, the retainer 230 is substantially fitted into the groove 219 of the inner housing 216 and the lock projections 231 of the retainer 230 are oriented to face the end surface 216A (see FIG. 23) of the inner housing 216. In this state, the inner housing 216 is pushed substantially to the back of the inner insertion hole 215 of the housing 10. Then, the inner housing 216 is locked in the inner insertion hole 215 by the unillustrated locking means and the lock projections 231 of the retainer 230 engage the end surface 216A of the inner housing 216, with the result that the retainer 230 is locked in the retainer insertion hole 220 (see FIG. 22) so as not to come out. In the connector according to this embodiment, the retainer insertion hole 220 is formed by the inner housing 216 and the housing 10 which are detachable from each other. Accordingly, the housings 10, 216 are detached from each other and the retainer insertion hole 220 can be opened wider than the groove 219 of the inner housing 216. Thus, the retainer 230 can easily be assembled into the housing 10, without being hindered or restricted e.g. by the groove 219.

Figure 24:
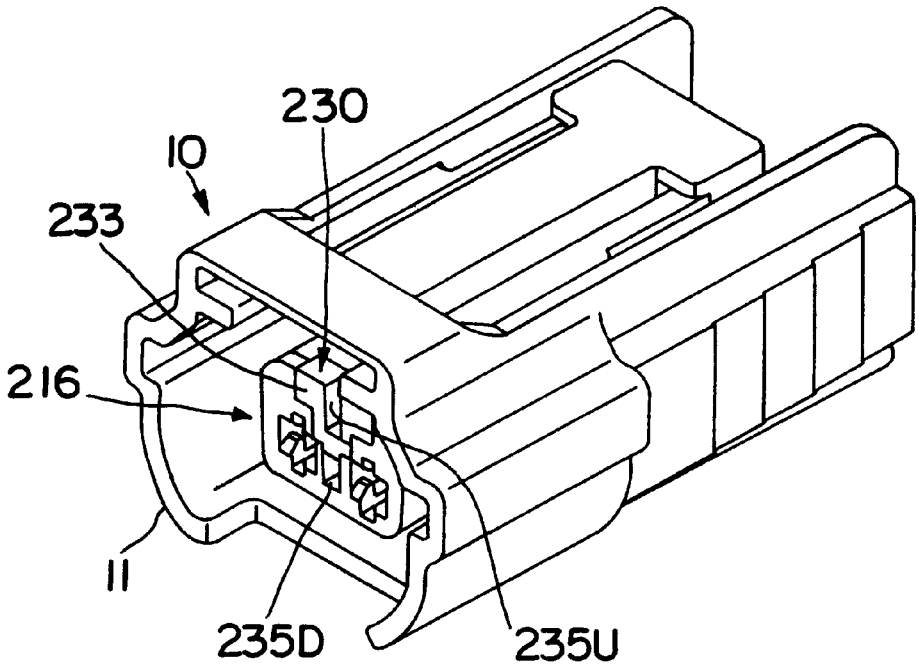
FIG. 24 is a perspective view of the connector assembled.

Next, the retainer 230 is set in the non-lock position in the retainer insertion hole 220 by inserting the specified jig into the lower one 235D of the pair of jig insertion spaces 235U, 235D shown in FIG. 24. Here, the jig insertion space 235D becomes narrower toward the back due to the tapered surface 234D (see FIG. 25). A force for merely pushing the jig to the back acts in such a direction as to widen the space 235D. As a result, the retainer 230 is moved to the upper side of the retainer insertion hole 220 to be held in the non-lock position. The connector is transported to the harness producing factory in this state.

In the harness producing factory, the terminal fittings 240 are assembled into this connector. In the connector transported to the harness producing factory, the retainer 230 is in its non-lock position and, therefore, the lock projections 231 substantially do not project into the cavities 222 (see FIGS. 22 and 27). The terminal fittings 240 may be pushed or inserted into the cavities 222 with the connector substantially in this state. During the insertion, the metal locking portions 243 of the terminal fittings 240 are deformed inwardly by coming into contact with the receiving projections 223 (see FIG. 22). When the terminal fittings 240 are pushed further, the metal locking port ions 243 are restored preferably to substantially their original shape upon moving beyond the receiving projections 223, thereby lockingly engaging the projections 223. This is referred to as primary locking. At this time, the base portions 241 of the terminal fittings 240 substantially come into contact with contact walls (not shown) of the cavities 222, and thereby are positioned with respect to the forward direction.

In this state, the retainer 230 is displaced to its lock position preferably by pushing the specified jig into the upper one of the pair of jig insertion spaces 235U, 235D shown in FIG. 24. Here, the jig insertion space 235U is narrower toward the back due to the tapered surface 234U (see FIG. 25). A force for merely pushing the jig to the back acts in such a direction as to substantially widen the space 235U, thereby pushing the retainer 230 downwardly. Then, the retainer 230 is moved to the bottom side of the groove 219 and is positioned preferably by the engagement of the stepped surface of the restricting projection 233 and the stepped surface of the groove 219. As a result, the retainer 230 is located in its lock position and the lock protuberance 231B of the retainer 230 moves over the receiving protuberance 215B to be locked below it (see FIG. 29). In this state, the lock projections 231 of the retainer 230 project into the cavities 222 (see FIG. 28) to substantially face the rear end surfaces 241B of the terminal base portions 241 of the terminal fittings 240, so that the terminal fittings 240 are locked directly by the retainer 230. This is referred to as secondary locking. Here, if the terminal fittings 240 are left insufficiently inserted, the terminal base portions 241 are located in the communicating portions of the cavities 222 with the back space 218, thereby interfering with the lock projections 231 of the retainer 230. Therefore, the retainer 230 cannot be lowered even if the jig is inserted into the space 235U. As a result, the insufficient insertion of the terminal fittings 240 can be detected.

When this connector is connected with the mating connector, the male tabs of the mating connector are inserted into the cavities 222 to be connected electrically and the inside of each cavity 222 preferably is held watertight by the waterproof ring 14 between the connectors and the waterproof rubber plug 247 in the cavity 222. Here, unless the retainer 230 is in its lock position, the mating connector cannot be inserted into the space 13 because of the restricting projection 233 projecting into the space 13. This prevents the connectors from being assembled without being doubly locked.

As described above, according to the connector of this embodiment, the terminal fittings 240 can be retained with a strong force since they substantially can be directly locked by the retainer 230. Further, since the opening of the retainer insertion hole 220 into which the retainer 230 is inserted is located in the front surface of the housing 10, it is not exposed to the outside by being covered by the mating connector. In other words, the connector of this embodiment has advantages of both side retainer type and front retainer type connectors of prior art and can retain the terminal fittings with a large force while being designed to be watertight.

Figure 32:
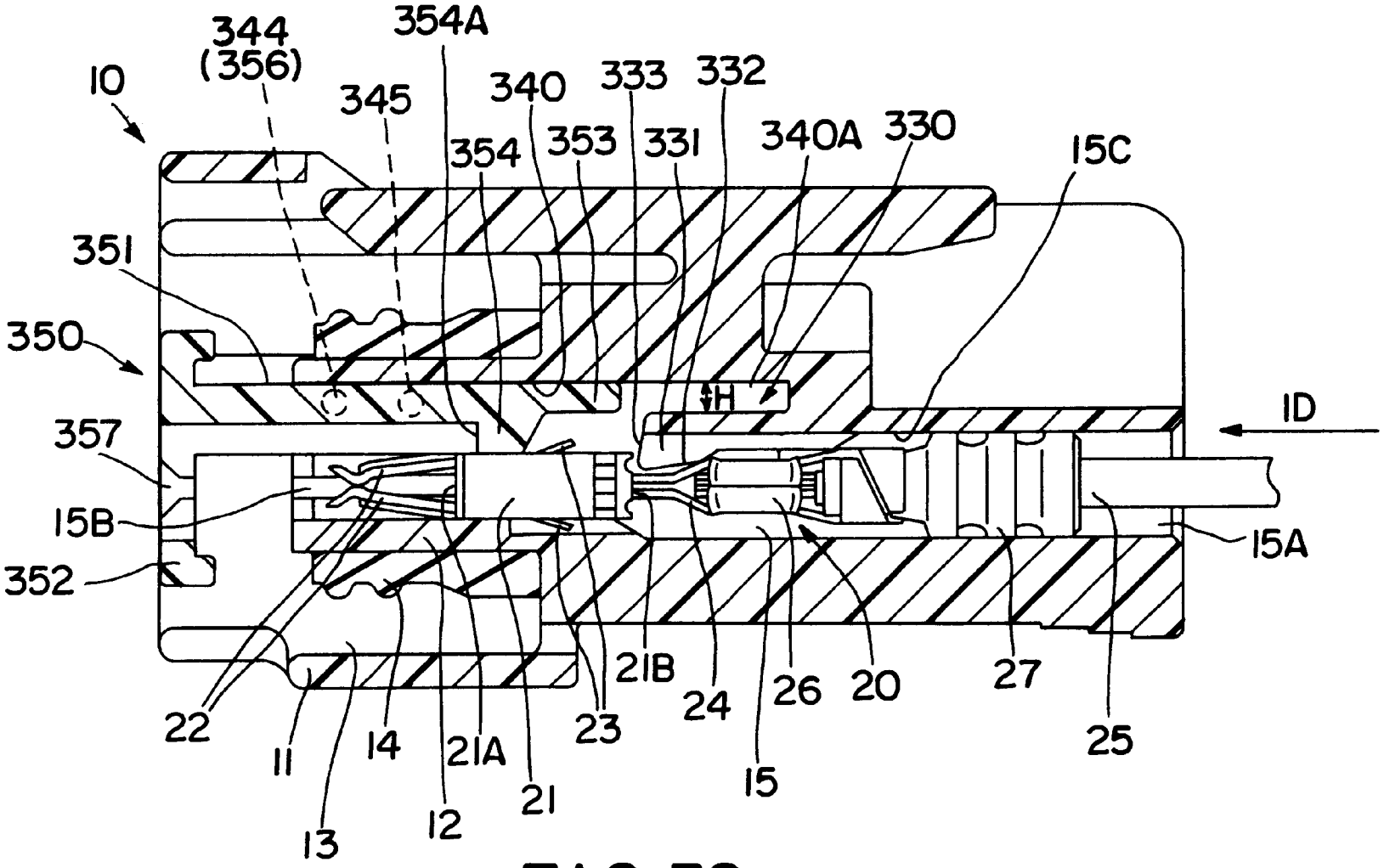
FIG. 32 is a side view in section of a connector provided with a retainer according to a fifth embodiment of the invention.

A fifth embodiment of the invention is described with reference to FIGS. 32 to 39, and includes a connector housing 10. A left end surface of the housing 10 in FIG. 32 is a front surface to be engaged with a mating connector (not shown). A receptacle of the mating connector is fitted into a space 13 between a receptacle 11 projecting substantially forward from the front surface of the housing 10 and a main body 12 inside the receptacle 11 for the connection of the two connectors. A waterproof ring 14 preferably is fitted on the outer surface of the main body 12 and is brought or bringable into sealing contact with the inner surface of the mating receptacle and the outer surface of the main body 12 by being deformed compressively therebetween.

Figure 33:
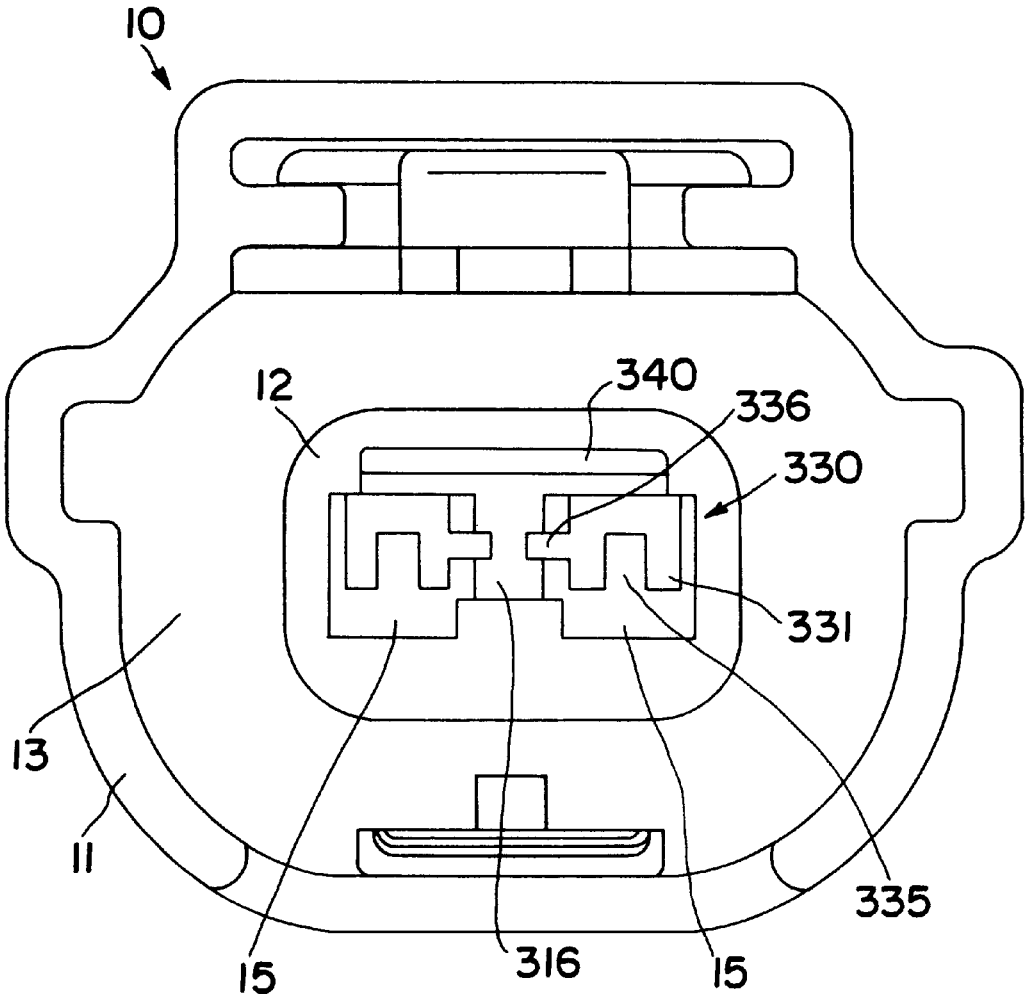
FIG. 33 is a front view of a housing of the connector.

Inside the housing 10, a pair of cavities 15 are provided in the form of through holes extending in engaging direction with a mating connector. Terminal fittings 20 are inserted or insertable through terminal insertion openings 15A of the cavities 15 which are open preferably at the rear side (right side in FIG. 32) of the housing 10. The terminal fittings 20 are electrically connected or connectable with male tabs (not shown) of a mating connector inserted through tab insertion openings 15B of the cavities 15 which are open at the front side of the housing 10. Further, as shown in FIG. 33, a jig insertion hole 316 is formed between the cavities 15 of the main body 12. This jig insertion hole 316 is open in the front surface of the main body 12 and communicates with the cavities 15 to the side surface of a resin locking portion 330 to be described later. The resin locking portion 330 is disengageable from the terminal fitting 20 by inserting a specified jig into the jig insertion hole 316.

The terminal fittings 20 are formed as shown in FIG. 32 e.g. by successively cutting a conductive metal plate and bending the cut pieces. A front end surface 21A of a terminal base portion 21 substantially in the form of a rectangular parallelepiped is brought into contact with a contact wall (not shown) formed in the cavity 15, thereby positioning the terminal fitting 20 in the cavity 15 with respect to forward direction (see FIG. 32). A pair of opposite pieces 22 extend forwardly in directions toward each other from the front end surface 21A of the terminal base portion 21, and the male tab of the mating connector is held between these opposite pieces 22 to establish an electrical connection. Further, a pair of metal lances or locking portions 23 extend obliquely backward from opposite side walls of the terminal base portion 21. A barrel portion 26 is formed on a rear end surface 21B of the terminal base portion 21. The barrel portion 26 has a raised portion 24 extending backward from a center portion of the rear end surface 21B and is adapted to connect a wire 25 at its leading end. An end of the wire 25 and a waterproof rubber plug 27 are connected with the barrel portion 26 as shown in FIG. 32, and this waterproof rubber plug 27 is in sealing contact with an external sheath of the wire 25 and the inner surface of the cavity 15.

In an intermediate position of each cavity 15 with respect to its longitudinal direction, a resin locking portion 330 extends substantially in the insertion direction ID of the terminal fitting 20 along a ceiling surface 15C of the cavity 15. The projecting end of the resin locking portion 330 hangs free, as shown in FIG. 32. Above the resin locking portions 330 in FIG. 32 is formed a retainer insertion hole 340 to be described later. The resin locking portions 330 are deformable toward the retainer insertion 340.

Figure 34:
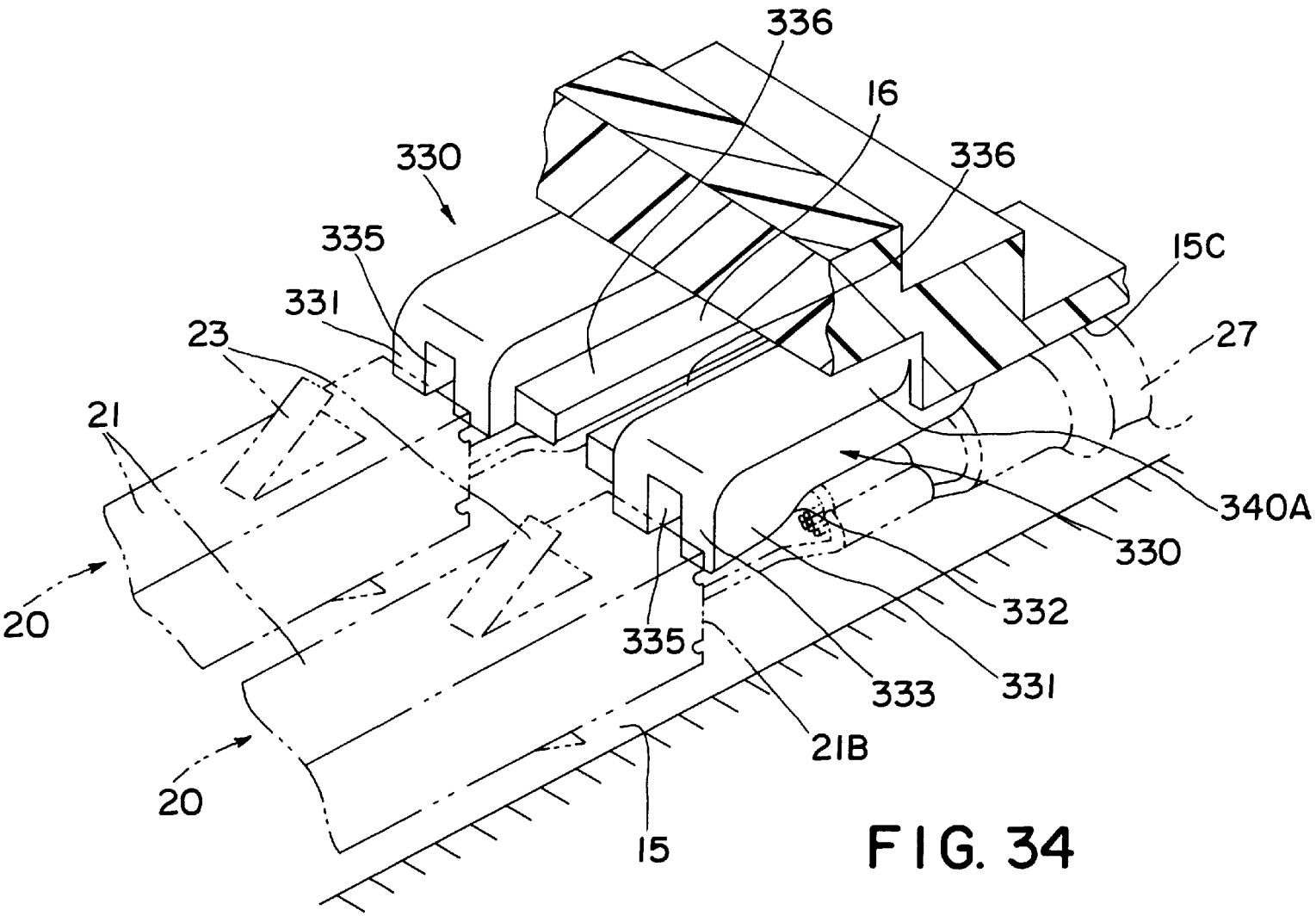
FIG. 34 is a perspective view of a resin locking portion.

At the leading end of each resin locking portion 330 is formed a lock projection 331 which projects substantially toward the terminal fitting 20. A surface of the locking projection 331 that substantially faces the terminal insertion opening 15A is a moderately slanted surface 332 with which the terminal base portion 21 is brought substantially into contact when being pushed into the cavity 15. A surface of the locking projection 331 substantially facing the terminal insertion opening 15B is a lock surface 333 which is lockingly engageable with the rear end surface 21B of the terminal base portion 21 when the terminal fitting 20 is pulled. Further, as shown in FIG. 34, an insertion groove 335 is formed substantially in the middle of the lock projection 331 with respect to its widthwise direction and substantially along the insertion direction of the terminal fitting 20 so as to substantially avoid the interference of the metal locking portion 23 and the lock projection 331. Operable projections 336 are provided on surfaces of the two resin locking portions 330 facing each other as shown in FIG. 34, so that the resin locking portions 330 can be deformed elastically by lifting the operable projections 336 by a jig inserted into the jig insertion hole 316.

The housing 10 is formed with the retainer insertion hole 340 which is substantially open in the front surface of the main body 12 as shown in FIG. 33. The retainer insertion hole 340 has a substantially rectangular cross section which is long along the transverse direction of FIG. 33; and is so arranged above the cavities 15 as to communicate with the upper parts of the cavities 15 and extend to an intermediate position of the housing 10 substantially in parallel with the cavities 15 (see FIG. 32). The back of the retainer insertion hole 340 serves as a deformation area 340A of the resin locking portion 330 (see FIG. 32).

Figure 35:
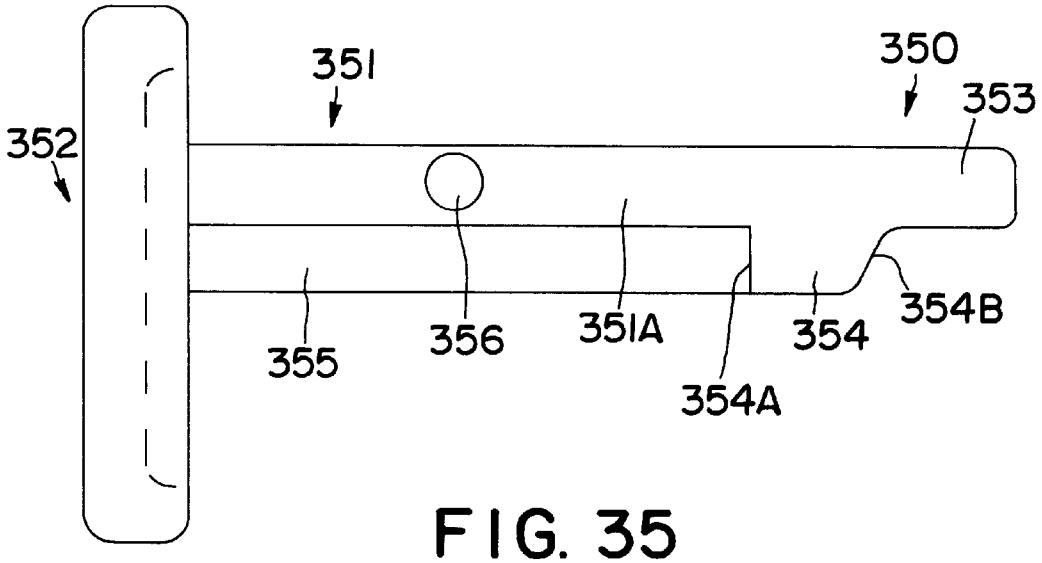
FIG. 35 is a side view of the retainer.

A retainer 350 is shown in FIG. 35 and is provided with an insertion portion 351 to be insertable into the retainer insertion hole 340 and a base portion 352 in the form of a substantially flat plate at the rear end of the insertion portion 351. The insertion portion 351 has substantially the same width or a corresponding width as the retainer insertion hole 340 and a length to be insertable to the back of the retainer insertion hole 340. The leading end of the insertion portion 351 acts as a restricting portion 353 for preventing the elastic deformation of the resin locking portions 330 by being accommodated in the deformation area 340A. Preferably, the thickness of the restricting portion 353 is substantially equal or corresponds to the height H (FIG. 32) of the deformation area 340A.

A pair of receiving projections 354 are provided on a surface of the insertion portion 351 facing downwardly in FIG. 35. The pair of receiving projections 354 substantially correspond to the metal locking portions 23 of the respective terminal fittings 20. A vertical surface 354A of the receiving projection 354 substantially facing to the right of FIG. 35 is lockingly engageable with the metal locking portion 23 in such a direction as to prevent the terminal fitting 20 from coming out. A right end or engagement surface of the receiving projection 354 is a tapered surface 354B inclined downward to the left of FIG. 35. The metal locking portion 23 is deformed smoothly toward the outer surface of the terminal main body 21 by the tapered surface 354B when the terminal fitting 20 is inserted into the cavity 15. Further, as shown in FIG. 36, reinforcing ribs 355 extend from the inner positions of the vertical surfaces 354A of the respective receiving projections 354 to the base portion 352 in such a manner as not to interfere with the metal locking portions 23.

Figure 36:
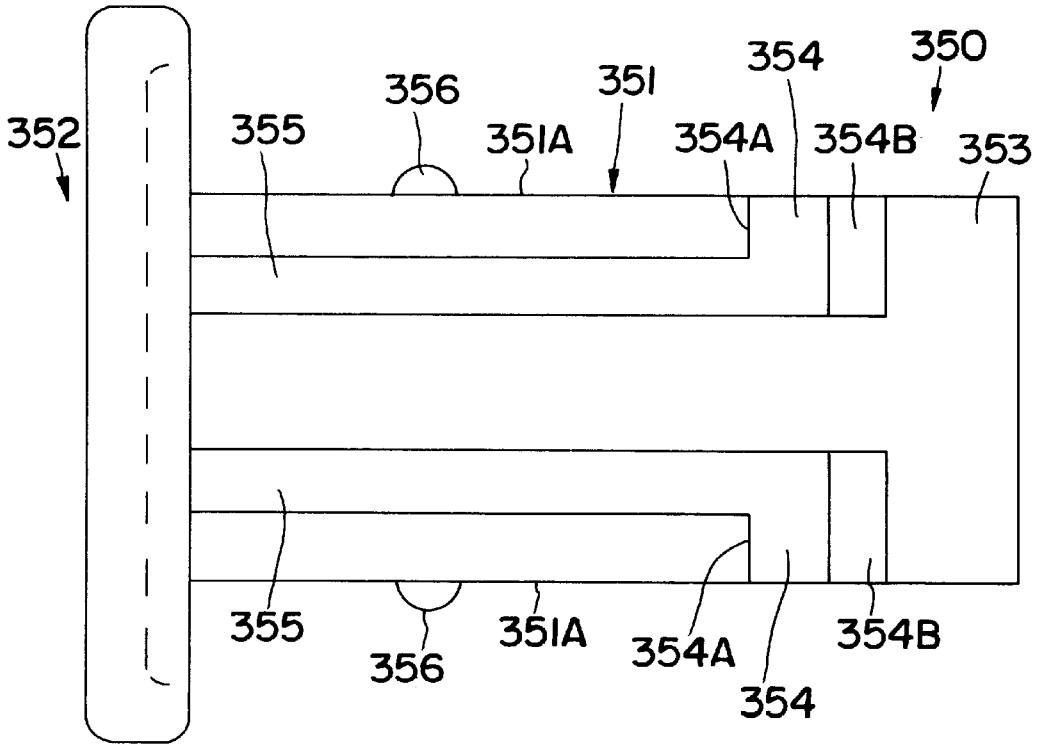
FIG. 36 is a bottom view of the retainer.

A pair of protuberances 356 project from opposite side surfaces 351A of the insertion portion 351 as shown in FIG. 36. When the retainer 350 is inserted to a position before the restricting portion 353 at the leading end of the insertion portion 351 reaches the deformation area 340A (see FIG. 32), the protuberances 356 are substantially engaged with partial lock recesses 344 formed in the opposite inner side surfaces of the retainer insertion hole 340 (this is referred to as partial locking of the retainer 350). When the restricting portion 353 reaches a position where it is accommodated in the deformation area 340A (see FIG. 38), the protuberances 356 are substantially engaged with full lock recesses 345 formed in the opposite inner side surfaces of the retainer insertion hole 340 (this is referred to as full locking of the retainer 350). Accordingly, the retainer 350 is not inadvertently moved from the respective lock positions.

Figure 37:
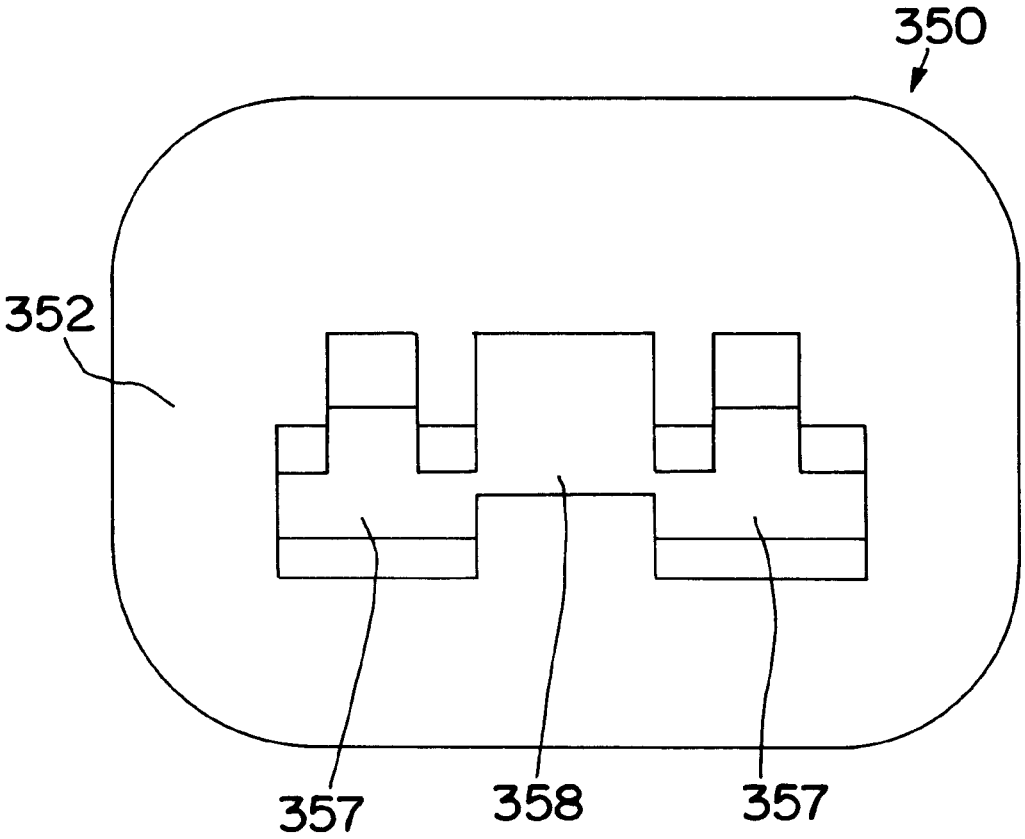
FIG. 37 is a front view of the retainer.
Figure 38:
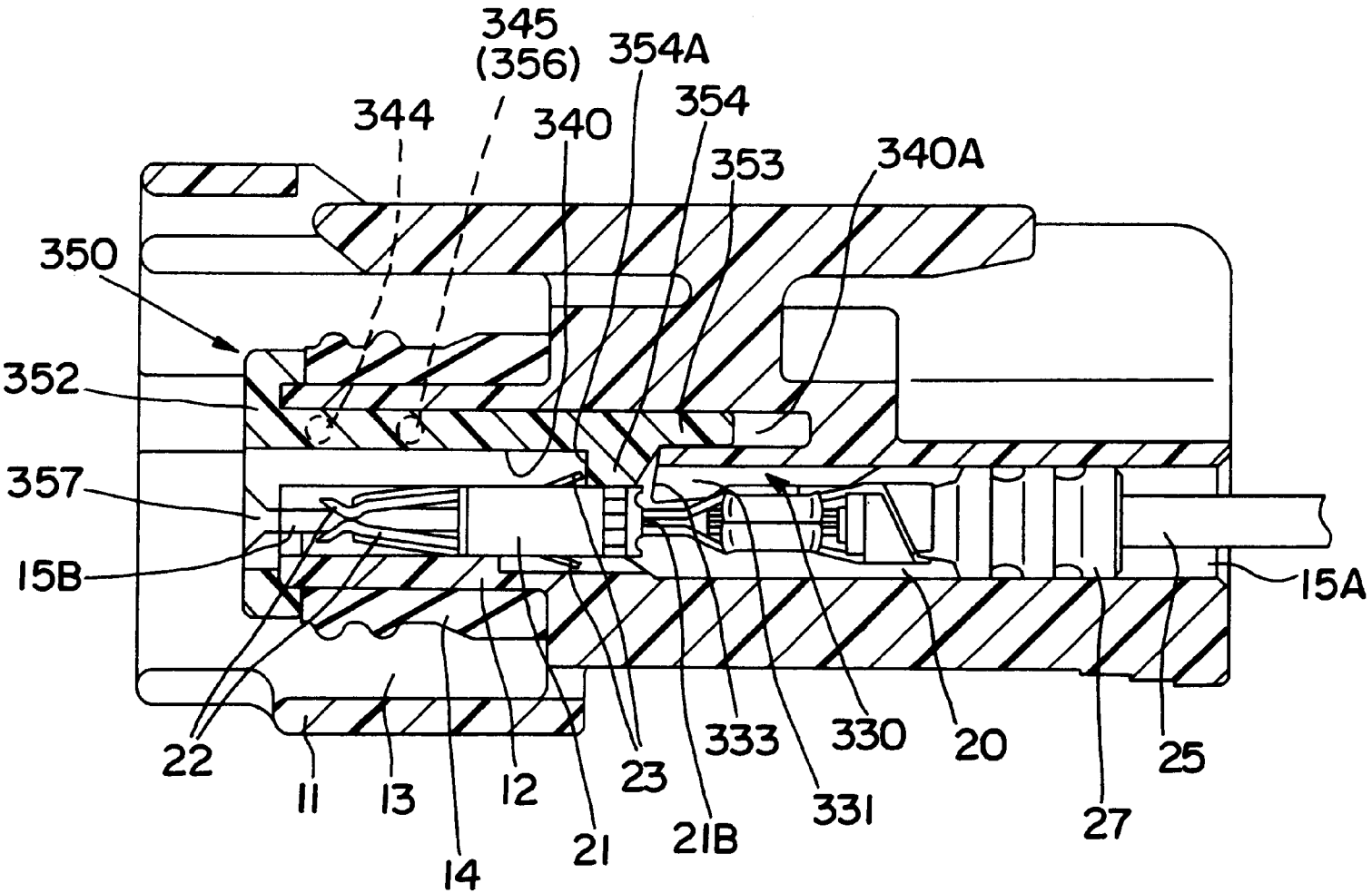
FIG. 38 is a front view of the connector when the retainer is in its full lock position.
Figure 39:
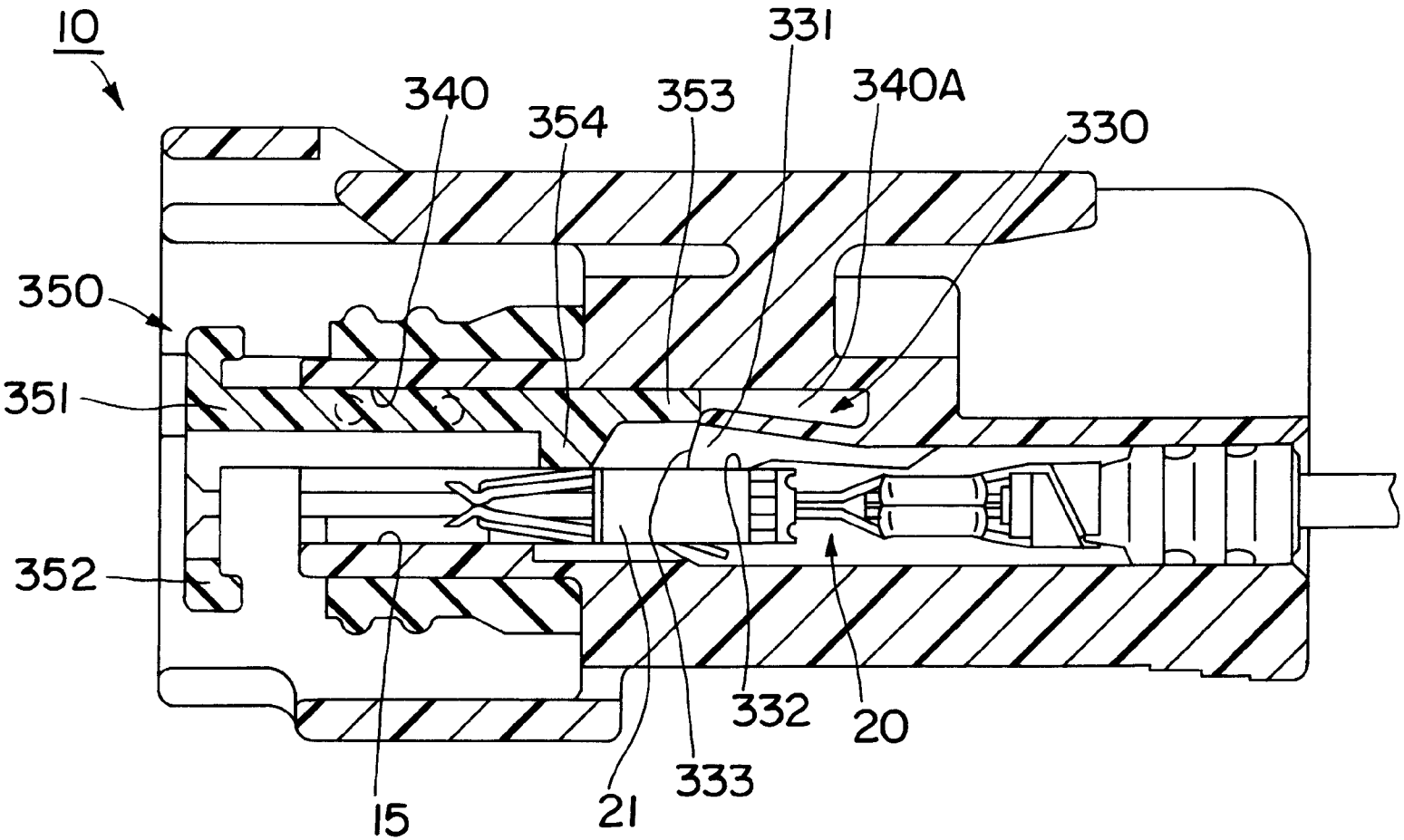
FIG. 39 is a side view in section of the connector with terminal fittings insufficiently inserted.
Figure 40:
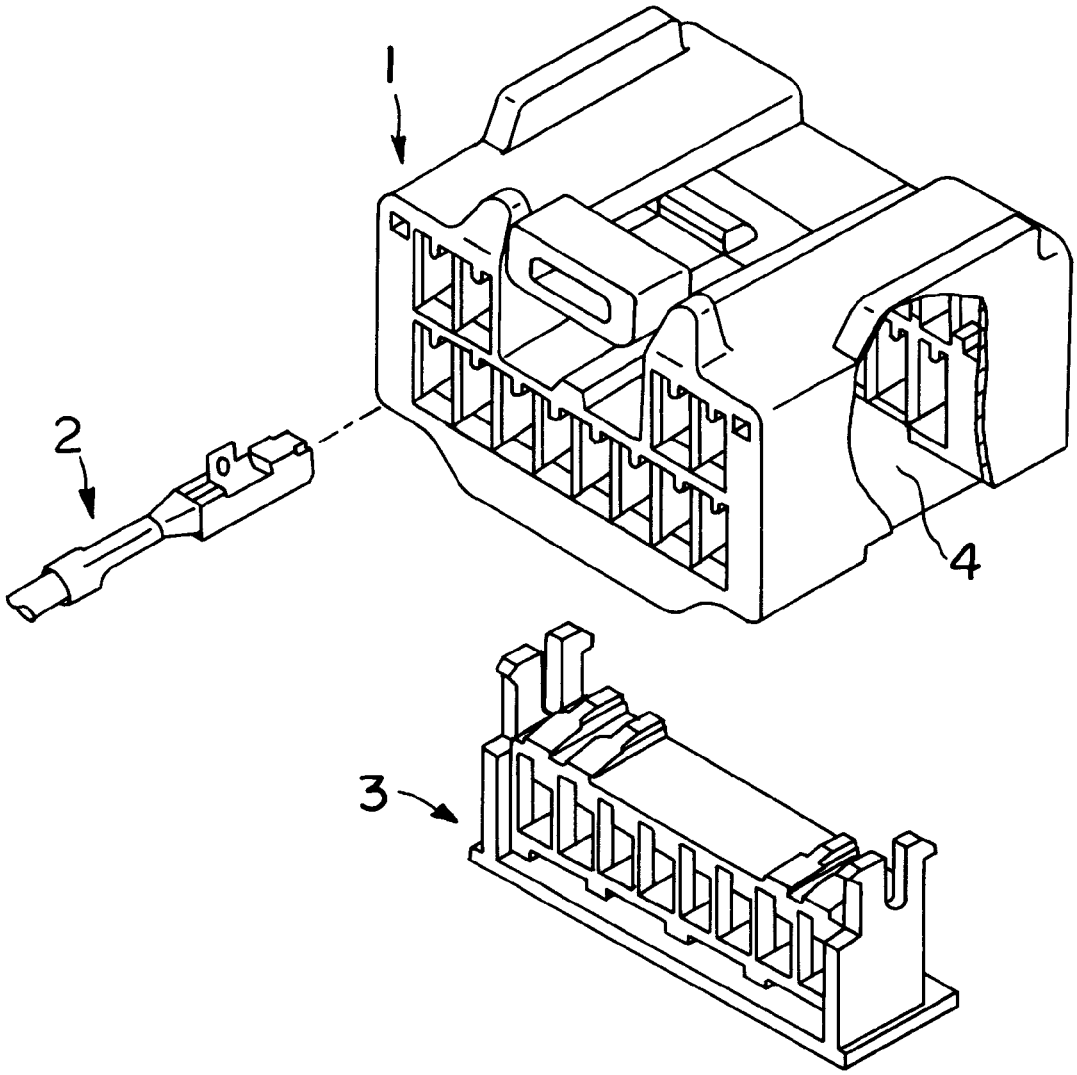
FIG. 40 PRIOR ART
FIG. 40 is a perspective view of a side retainer type connector of prior art.
Figure 41:
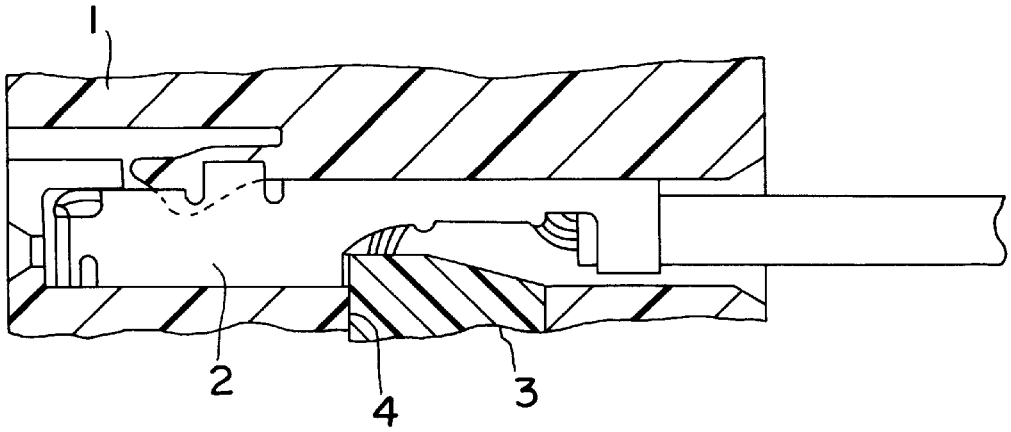
FIG. 41 PRIOR ART
FIG. 41 is a partial section of the side retainer type connector.
Figure 42:
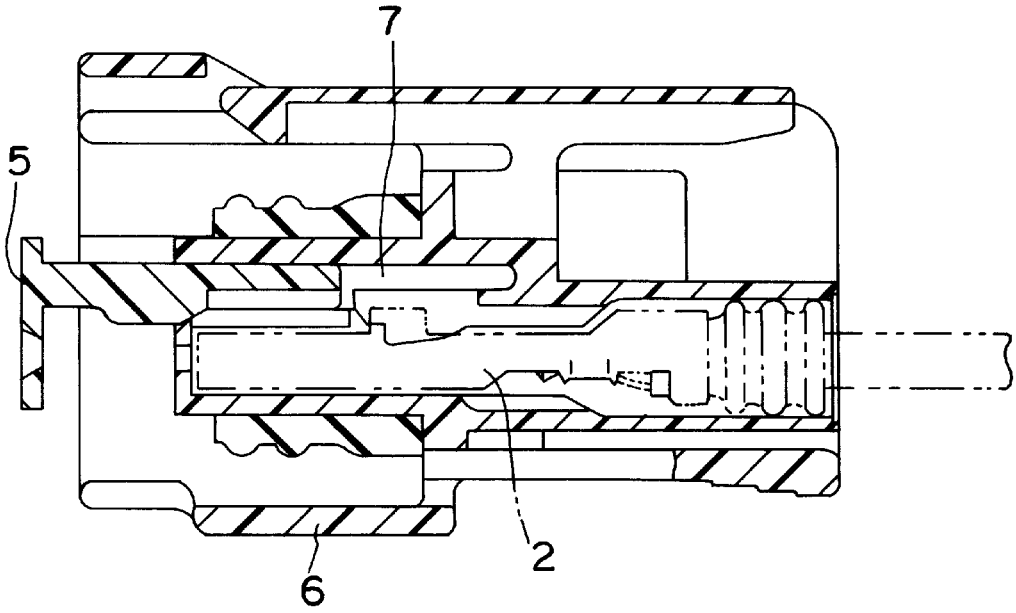
FIG. 42 PRIOR ART
FIG. 42 is a side view in section of a front retainer type of prior art.

The base portion 352 of the retainer 350 has a substantially rectangular cross section with rounded corners which substantially conform or correspond to the shape of the front surface of the main body 12. The base portion 352 is formed with a pair of through holes 357 for tabs substantially corresponding to the tab insertion openings 15B and a through hole 358 for the jig substantially corresponding to the jig insertion hole 316 as shown in FIG. 37. The base portion 352 preferably bulges out slightly sideways from the main body 12 as shown in FIG. 38 to face the waterproof ring 14 and acts as a stopper for the waterproof ring 14 by facing opposite to it.

Generally, a connector producing factory and a harness producing factory where terminal fittings connected with ends of wires are assembled into connectors are located in separate places.

In the connector producing factory, the insertion portion 351 of the retainer 350 is inserted partway into the retainer insertion hole 340 of the housing 10 to partly lock the retainer 350 with the housing 10. Then, the protuberances 356 of the insertion portion 351 are engaged with the partial lock recesses 344 of the retainer insertion hole 340, thereby partially locking the retainer 350. The connectors are transported to the harness producing factory in this state.

In the harness producing factory, the terminal fittings 20 are assembled into the connector. In order to do so, the terminal fittings 20 may simply be pushed or inserted into the cavities 15 with the retainer 350 partly locked. Then, the terminal base portions 21 are brought obliquely into contact with the slanted surfaces 332 of the resin locking portions 330, thereby pushing or deflecting or displacing the resin locking portions 330 toward the deformation area 340A. The restricting portion 353 is not accommodated in the deformation area 340A while the retainer 350 is partly locked (see FIG. 32). Accordingly, the resin locking portions 330 can be deformed elastically toward the deformation area 340A, so that the terminal fittings 20 can be inserted substantially to the back of the cavities 15. During this insertion, since the metal locking portions 23 do not interfere with the lock projections 331 by passing along or in the insertion grooves 335 formed in the lock projections 331, a resistance which acts during the insertion of the terminal fittings 20 is not large. When the terminal fittings 20 reach the back of the cavities 15, the resin locking portions 330 are restored substantially to their original shapes upon moving beyond the terminal base portions 21, and the lock surfaces 333 of the resin locking portions 330 are engaged with the rear end surfaces 21B of the terminal base portions 21. At this time, the terminal base portions 21 come substantially into abutment against contact walls (not shown) of the cavities 15, thereby substantially positioning the terminal fittings 20 with respect to forward direction.

In this state, the retainer 350 is pushed to the back or further into the connector. Then, the protuberances 356 are disengaged from the partial lock recesses 344 and the retainer 350 is moved to the back. When the receiving projections 354 of the retainer 350 pass the metal locking portions 23 of the terminal fittings 20 while deforming them, the metal locking portions 23 are restored substantially to their original shape, thereby lockingly engaging the vertical surfaces 354A of the receiving projections 354. Simultaneously, the restricting portions 353 of the retainer 350 are accommodated in the deformation area 340A of the resin locking portions 330 to restrict the elastic deformation of the resin locking portions 330, enhancing the locking force thereof. When the retainer 350 is pushed to this position, the base portion 352 of the retainer 350 comes into contact with the front surface with the housing 10 as shown in FIG. 38 and, accordingly, the retainer 350 cannot be pushed any further. In this state, the protuberances 356 are engaged with the full lock recesses 345, effecting the full locking of the retainer 350.

Finally, when th is connector in which the retainer 350 is fully locked is connected with the mating connector, the tabs of the mating connector are inserted into the cavities 15 to be connected electrically and the inside of each cavity 15 preferably is held watertight by the waterproof ring 14 between the connectors and the waterproof rubber plug 27 in the cavity 15.

In this connector, if the retainer 350 is pushed with the terminal fittings 20 insufficiently inserted (FIG. 39), the resin locking portions 330 project into the deformation area 340A, thereby interfering with the restricting portions 353. The insufficient insertion of the terminal fittings 20 can be noticed because the retainer 350 cannot be pushed to the back of the retainer insertion hole 340.

Further, to detach the terminal fittings 20 from the fully locked connector, the retainer 350 is first detached by deforming the locking portions 23 downwardly while inserting a specified jig into the tab insertion opening 15B (see FIG. 38). Subsequently, the terminal fittings 20 are detached by lifting the operable projections 336 of the retainer 350 while inserting the specified jig into the jig insertion hole 316 (see FIG. 33). At this time, since the metal locking portions 23 and the lock projections 331 do not interfere with each other along the insertion direction of the terminal fittings 20 by the presence of the insertion grooves 335, the terminal fittings 20 can be detached easily.

As described above, according to the connector of this embodiment, the locking force of the resin locking portions 330 is improved by the retainer 350 and each terminal fitting 20 is locked by the two locking portions, namely, the resin locking portion 330 and the metal locking portion 23. Accordingly, the terminal fittings 20 can be retained with a strong force. Further, since the opening of the retainer insertion hole 330 is located in the front surface of the housing 10, it is covered by the mating connector and not exposed to the outside. In other words, the connector of this embodiment has advantages of both side retainer type and front retainer type connectors of prior art and can retain the terminal fittings 20 with a large force while being designed to be watertight.

The present invention is not limited to the described and illustrated embodiments, but the following embodiments are also embraced by the technical scope of the present invention as defined by the claims. Besides the following embodiments, a variety of other changes can be made without departing from the scope and spirit of the invention as defined by the claims.

Although the present invention is applied to the watertight connector in the foregoing embodiments, it may be applicable to nonwatertight connectors.

Although the guide portions (tapered surfaces 32, 33; 131; 160) of the foregoing embodiments are provided in the insertion holes 30, 31; 130; 155, they may be provided in the retainer or in both the retainer and the insertion hole(s).

The guide portions are not limited to planar slanted surfaces like the tapered surfaces 32, 33 of the foregoing embodiments, but may have an arcuate shape so as to guide the retainer toward the terminal fittings along an arcuate path.

The guide portion is not limited to the slanted planar surface like the tapered surfaces 131, 160 of the foregoing embodiments. It may be an arcuate surface.

In the foregoing embodiments, the tapered surfaces 234U, 234D are provided in the jig insertion spaces 235U, 235D and the jig inserting force is translated into a force for sliding the retainer 230. However, instead of providing the tapered surface in the jig insertion spaces, a tapered portion may, for example, be provided at the leading end of the jig. If the tapered surfaces 234U, 234D are provided in the jig insertion spaces 235U, 235D as in the foregoing embodiment, the connector can more generally be used since a jig of a special shape is not necessary. Alternatively or additionally the tapered surface may be provided on the connector housing 10.

What is claimed is:

1. A connector comprising a connector housing with a front surface for mating with another connector and an opposed rear surface, at least one cavity extending through the connector housing from the rear surface to the front surface for receiving at least one terminal fitting, a retainer insertion hole and an auxiliary retainer insertion hole extending into the front surface, at least one terminal fitting inserted in the cavity of the connector housing along an insertion direction, a retainer having an insertion portion insertable into the retainer insertion hole substantially from the front surface of the connector housing, a base portion provided at a base end of the insertion portion so as to substantially face the front surface of the connector housing, and an auxiliary insertion portion which projects from the base portion, the auxiliary insertion portion being substantially shorter than the insertion portion and being insertable into the auxiliary insertion hole, the retainer being movable in the connector housing to a lock position in an oblique direction relative to the insertion direction of the terminal fitting inside the connector housing, guide portions being provided on at least one of the leading end of the insertion portion and the retainer insertion hole and on at least one of the leading end of the auxiliary insertion portion and the auxiliary insertion hole for guiding at least a portion of the retainer in the oblique direction to the locked position, the guide portions being arranged at least partially at an angle different from 0° and 180° with respect to the insertion direction, the retainer having a lock portion which substantially prevents the terminal fitting from coming out when the retainer is positioned substantially in the lock position.

2. A connector according to claim 1, wherein the retainer insertion hole is dimensioned such that the retainer is shiftable along a shifting direction intersecting with the insertion direction of the terminal fitting inside the connector housing.

3. A connector according to claim 1, wherein the lock portion is configured to interfere with one of the at least one terminal fittings that is insufficiently inserted into the connector housing for preventing the movement of the retainer to the lock position.

4. A connector according to claim 1, wherein the terminal fitting is substantially inserted from a rear surface of the connector housing which is opposite the front surface.

5. A connector according to claim 1, further comprising a partial lock means for locking the retainer on the connector housing in a position where the lock portion does not lock the terminal fitting and a full lock means for locking the retainer on the connector housing in the lock position.

6. A connector according to claim 1, wherein the guide portion is a slanted portion provided on the connector housing.

7. A connector according to claim 1, wherein the retainer is configured to prevent a mating connector from being inserted into the connector when the retainer is not positioned in its lock position.

8. A connector according to claim 1, wherein the at least one cavity comprises at least first and second substantially parallel spaced apart cavities, the retainer insertion hole having a portion communicating with the cavities, the auxiliary retainer insertion hole being spaced from the cavities and spaced from the retainer insertion hole.

9. A connector according to claim 1, wherein the base portion of the retainer has at least one through hole extending therethrough and disposed for registration respectively with the at least one cavity at the front surface of the connector housing, the base portion of the retainer further being configured to cover areas of the front surface of the connector housing surrounding the cavity when the retainer is moved into the locked position.

10. A connector according to claim 9, wherein the through hole in the base portion of the retainer is offset from the cavity in the front surface of the connector housing when the retainer is spaced from the locked position.

* * * * *